US008888239B2

(12) United States Patent
Maeda et al.

(10) Patent No.: US 8,888,239 B2
(45) Date of Patent: Nov. 18, 2014

(54) INKJET PRINTER

(71) Applicant: Dainippon Screen Mfg. Co., Ltd, Kyoto (JP)

(72) Inventors: Toshio Maeda, Kyoto (JP); Keisuke Hirayama, Kyoto (JP); Tamio Fukui, Kyoto (JP)

(73) Assignee: Dainippon Screen Mfg. Co., Ltd, Kyoto-Shi, Kyoto (JP)

( * ) Notice: Subject to any disclaimer, the term of this patent is extended or adjusted under 35 U.S.C. 154(b) by 0 days.

(21) Appl. No.: 14/183,028

(22) Filed: Feb. 18, 2014

(65) Prior Publication Data

US 2014/0232785 A1 Aug. 21, 2014

(30) Foreign Application Priority Data

Feb. 18, 2013 (JP) ..... 2013-029127 P
Aug. 7, 2013 (JP) ..... 2013-163971 P

(51) Int. Cl.
*B41J 2/15* (2006.01)
*B41J 2/145* (2006.01)

(52) U.S. Cl.
CPC ..... *B41J 2/145* (2013.01)
USPC ..... 347/40

(58) Field of Classification Search
CPC .... B41J 2/155; B41J 2202/20; B41J 2202/19; B41J 2/145; B41J 2/15
USPC ..... 347/20, 37, 40
See application file for complete search history.

(56) References Cited

U.S. PATENT DOCUMENTS

| | | | | |
|---|---|---|---|---|
| 8,128,200 | B2 * | 3/2012 | Kasahara et al. | 347/40 |
| 8,567,891 | B2 * | 10/2013 | Nagoshi et al. | 347/15 |
| 8,668,299 | B2 * | 3/2014 | Tanase et al. | 347/15 |
| 2010/0134545 | A1 | 6/2010 | Murai et al. | |
| 2011/0310155 | A1 | 12/2011 | Nagoshi et al. | |
| 2011/0316910 | A1 | 12/2011 | Azuma et al. | |
| 2011/0316911 | A1 | 12/2011 | Ishikawa et al. | |

FOREIGN PATENT DOCUMENTS

| | | |
|---|---|---|
| EP | 2402888 A2 | 1/2012 |
| JP | 2012-6267 | 1/2012 |

OTHER PUBLICATIONS

European Search Report issued in corresponding European Application No. 14154416.3, dated May 27, 2014.

* cited by examiner

*Primary Examiner* — An Do
(74) *Attorney, Agent, or Firm* — McDermott Will & Emery LLP

(57) ABSTRACT

In an inkjet printer, a first sparsely arranged portion of a first ejection head entirely overlaps in a movement direction with a second densely arranged portion of a second ejection head. A plurality of outlets of the first sparsely arranged portion include use outlets, and among a plurality of outlets of the second densely arranged portion, those that overlap in the movement direction with use outlets of the first sparsely arranged portion are non-use outlets. In an overlapping range of the first ejection head and the second ejection head, outlets of both of the ejection heads are used in recording an image onto a base material. Consequently, it is possible to prevent or suppress a reduction in print quality such as changes in density or the occurrence of voids due to displacement of the mounting positions of ejection heads in the overlapping range.

19 Claims, 22 Drawing Sheets

INKJET PRINTER

TECHNICAL FIELD

The present invention relates to an inkjet printer.

BACKGROUND ART

Conventionally, inkjet printers have been used to print an image onto printing paper by moving the printing paper relative to a head unit and ejecting fine droplets of ink from a plurality of outlets of the head unit toward the printing paper. An inkjet printer that carries out color printing is provided with a plurality of head assemblies that respectively correspond to inks of a plurality of colors. Each of the head assemblies has, for example, a plurality of heads arranged in a staggered configuration, each of the heads including a plurality of outlets.

Japanese Patent Application Laid-Open No. 2012-6267 (Document 1) discloses an inkjet recording apparatus that includes four connected heads for ejecting inks of black, cyan, magenta, and yellow, respectively. Each of the connected heads has a plurality of chips arranged in a direction (hereinafter, referred to as an "arrangement direction") that intersects a direction of conveyance of a recording medium. Each of the chips has a plurality of nozzles for ejecting droplets of ink arranged at equal pitches in the arrangement direction. In the connected heads, the chips are arranged in a staggered configuration such that each two chips adjacent in the arrangement direction overlap partly with each other in the conveyance direction. In such an inkjet recording apparatus, a plurality of nozzles are aligned in the conveyance direction in areas where chips overlap with each other. Thus, a line that extends in the conveyance direction can be recorded by ejecting droplets of ink alternately from a plurality of nozzles.

Here, a configuration of the above head assemblies is conceivable in which heads each having outlets arranged such that the pitch of outlets in opposite longitudinal end portions is greater than that in a central portion are arranged in a staggered configuration in the arrangement direction as in Document 1. In this case, at the time of assembly of the head assemblies, a plurality of heads are positioned and fixed such that in end portions of each two heads that overlap with each other in the movement direction, the outlets of one head are each disposed between the outlets of the other head in the movement direction. In this way, in the range of overlap between the two heads, outlets are interpolated in positions where there are no outlets of these heads so as to make the pitch of outlets in the overlapping range equal to that in the central portion of the heads.

In the case of an inkjet printer where high resolution is required, however, the arrangement pitch of outlets is very small and thus there is a limit to the accuracy of alignment at the time of fixing the heads. If the mounting positions of two heads are displaced from design mounting positions, in the overlapping range between the heads, the outlets of one head that are interpolated between the outlets of the other head will be displaced, producing a plurality of ranges in which there are no outlets in the movement direction of printing paper. This consequently produces a plurality of voids extending in the movement direction on the printing paper and reduces print quality.

SUMMARY OF INVENTION

The present invention is intended for an inkjet printer, and it is an object of the present invention to suppress a reduction in print quality in the range of overlap between two heads adjacent in the arrangement direction.

An inkjet printer according to an embodiment of the present invention includes a head assembly for ejecting fine droplets of ink, and a conveying mechanism for causing a base material and the head assembly to move relative to each other in a predetermined movement direction. The head assembly includes a first ejection head having outlets arranged in an arrangement direction that intersects the movement direction, and a second ejection head having outlets arranged in the arrangement direction and being disposed at a position that is different from a position of the first ejection head in the movement direction and that is shifted from the first ejection head in the arrangement direction. The first ejection head includes a first densely arranged portion in which outlets are arranged at a predetermined arrangement pitch in the arrangement direction, and a first sparsely arranged portion disposed adjacent to the first densely arranged portion on one side in the arrangement direction and in which outlets are more sparsely arranged in the arrangement direction than in the first densely arranged portion. The second ejection head includes a second densely arranged portion in which outlets are arranged at the arrangement pitch in the arrangement direction, and a second sparsely arranged portion disposed adjacent to the second densely arranged portion on the other side in the arrangement direction and in which outlets are more sparsely arranged in the arrangement direction than in the second densely arranged portion. The first sparsely arranged portion entirely overlaps in the movement direction with the second densely arranged portion, and the second sparsely arranged portion entirely overlaps in the movement direction with the first densely arranged portion. The outlets of the first sparsely arranged portion include a use outlet that is used in recording an image onto the base material. Among the outlets of the second densely arranged portion, an outlet that overlaps in the movement direction with the use outlet of the first sparsely arranged portion is a non-use outlet that is not used in recording an image onto the base material. With this inkjet printer, it is possible to suppress a reduction in print quality in the range of overlap between two heads adjacent in the arrangement direction.

In a preferred embodiment of the present invention, the outlets of the first sparsely arranged portion are all use outlets, and the outlets of the second sparsely arranged portion are all non-use outlets.

In another preferred embodiment of the present invention, in a dense overlapping range in the arrangement direction, part of the first densely arranged portion and part of the second densely arranged portion overlap with each other in the movement direction, and out of each two outlets that overlap with each other in the movement direction in the dense overlapping range, one outlet is a use outlet and the other outlet is a non-use outlet.

In another preferred embodiment of the present invention, the inkjet printer further includes a storage part for storing relationship information indicating a relationship between a plurality of overlapping states of the outlets of the first ejection head and the outlets of the second ejection head in the movement direction and use states of the outlets of the first sparsely arranged portion, the use states respectively corresponding to the plurality of overlapping states, and an ejection management part for, on the basis of the relationship information and an overlapping state between the outlets of the first ejection head and the outlets of the second ejection head, determining use or non-use of each outlet of the first sparsely arranged portion and determining, among the outlets of the second densely arranged portion, use or non-use of each outlet that overlaps in the movement direction with the first sparsely arranged portion.

Another inkjet printer according to the present invention includes a head assembly for ejecting fine droplets of ink, and a conveying mechanism for causing a base material and the head assembly to move relative to each other in a predetermined movement direction. The head assembly includes a first ejection head having outlets arranged in an arrangement direction that intersects the movement direction, and a second ejection head having outlets arranged in the arrangement direction and being disposed at a position that is different from a position of the first ejection head in the movement direction and that is shifted from the first ejection head in the arrangement direction. A size of the fine droplets of ink ejected from the outlets of the first ejection head and the second ejection head is switchable between a first size and a second size larger than the first size. The first ejection head includes a first densely arranged portion in which outlets are arranged at a predetermined arrangement pitch in the arrangement direction, and a first sparsely arranged portion disposed adjacent to the first densely arranged portion on one side in the arrangement direction and in which outlets are more sparsely arranged in the arrangement direction than in the first densely arranged portion. The second ejection head includes a second densely arranged portion in which outlets are arranged at the arrangement pitch in the arrangement direction, and a second sparsely arranged portion disposed adjacent to the second densely arranged portion on the other side in the arrangement direction and in which outlets are more sparsely arranged in the arrangement direction than in the second densely arranged portion. The first sparsely arranged portion entirely overlaps in the movement direction the second densely arranged portion, and the second sparsely arranged portion entirely overlaps in the movement direction with the first densely arranged portion. The outlets of the first sparsely arranged portion include a use outlet that is used in recording an image onto the base material. Among the outlets of the second densely arranged portion, an outlet that overlaps in the movement direction with the use outlet of the first sparsely arranged portion includes an auxiliary outlet that is used in an auxiliary manner in recording an image onto the base material. If a size of the fine droplets of ink ejected from the use outlet of the first sparsely arranged portion is greater than or equal to a predetermined size, the auxiliary outlet ejects fine droplets of ink of the first size. With this inkjet printer, it is possible to suppress a reduction in print quality in an overlapping range of two heads that are adjacent to each other in the arrangement direction.

In a preferred embodiment of the present invention, the outlets of the first sparsely arranged portion include a use outlet row that is a set of use outlets arranged at the arrangement pitch in the arrangement direction, and where two use outlets located at opposite ends in the arrangement direction of the use outlet row are end use outlets, among outlets of the second densely arranged portion that overlap in the movement direction with the use outlet row, an outlet that overlaps in the movement direction with one of the end use outlets in the use outlet row is an auxiliary outlet, and the other outlets are all non-use outlets that are not used in recording an image onto the base material.

In another preferred embodiment of the present invention, the outlets of the first sparsely arranged portion include a use outlet row that is a set of at least three use outlets arranged at the arrangement pitch in the arrangement direction, and where two use outlets located at opposite ends in the arrangement direction of the use outlet row are end use outlets, among outlets of the second densely arranged portion that overlap in the movement direction with the use outlet row, outlets that overlap in the movement direction with the two end use outlets in the use outlet row are auxiliary outlets, and the other outlets are all non-use outlets that are not used in recording an image onto the base material.

In another preferred embodiment of the present invention, in the first sparsely arranged portion, the number of outlets per unit length in the arrangement direction decreases as a distance in the arrangement direction from the first densely arranged portion increases.

In another preferred embodiment of the present invention, the inkjet printer further includes a recording control part for controlling the head assembly and the conveying mechanism to cause the base material and the head assembly to move relative to each other once in the movement direction and to record an image onto the base material.

These and other objects, features, aspects and advantages of the present invention will become more apparent from the following detailed description of the present invention when taken in conjunction with the accompanying drawings.

DESCRIPTION OF EMBODIMENTS

Figure 1:
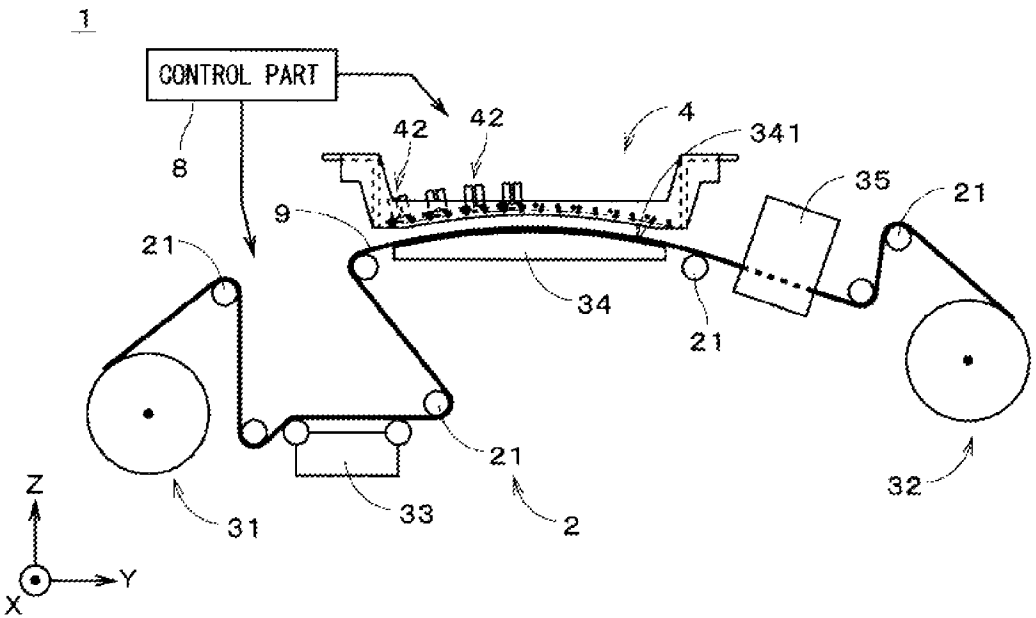
FIG. 1 illustrates a configuration of an inkjet printer according to a first embodiment of the present invention.

FIG. 1 illustrates a configuration of an inkjet printer 1 according to a first embodiment of the present invention. The inkjet printer 1 is an apparatus for forming an image on a base material 9 in continuous sheet form, such as continuous form paper, by ejecting fine droplets of ink toward the base material 9. In FIG. 1, it is assumed that the two horizontal directions perpendicular to each other are X and Y directions and the vertical direction perpendicular to the X and Y directions is a Z direction. The X and Y directions in FIG. 1 do not necessarily have to be in the horizontal direction, and the Z direction also does not necessarily have to be in the vertical direction. In other words, the upper and lower sides in FIG. 1 do not necessarily have to correspond to the upper and lower sides in the direction of gravity.

The inkjet printer 1 includes a conveying mechanism 2, a head unit 4, and a control part 8. The conveying mechanism 2 is configured to move the base material 9, which is in sheet form. The head unit 4 is configured to eject fine droplets of UV curing ink toward the base material 9 that is being moved by the conveying mechanism 2. The control part 8 is configured to control the conveying mechanism 2 and the head unit 4.

Figure 2:
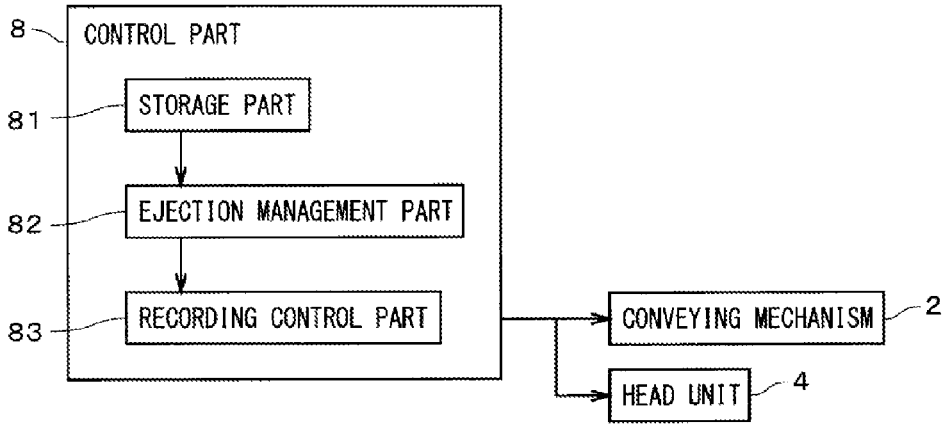
FIG. 2 is a block diagram showing functions of a control part.

FIG. 2 is a block diagram showing functions of the control part 8. FIG. 2 also illustrates other constituent elements of the inkjet printer 1. The control part 8 includes a storage part 81, an ejection management part 82, and a recording control part 83. The storage part 81 stores various types of information. The ejection management part 82 is configured to determine the use or non-use of a plurality of outlets 426 (see FIG. 7), which will be described later, of the head unit 4 prior to the recording of an image onto the base material 9. The recording control part 83 is configured to control the conveying mechanism 2 and the head unit 4 when an image is recorded onto the base material 9.

The conveying mechanism 2 shown in FIG. 1 includes a plurality of rollers 21 that are each long in the X direction in FIG. 1. In the vicinity of the roller 21 that is disposed furthest to the −Y side is provided a supply part 31 for holding a roll of base material 9 (supply roll). In the vicinity of the roller 21 that is disposed furthest to the +Y side is provided a take-up part 32 for holding the roll of base material 9 (take-up roll). In the inkjet printer 1, some of the rollers 21 of the conveying mechanism 2 rotate at a constant rotational speed about an axis parallel to the X direction, so that the base material 9 moves at a constant speed along a predetermined travel path from the supply part 31 to the take-up part 32.

On the travel path of the base material 9, a base material guiding part 34 is provided at a position opposing the head unit 4 in the vertical direction. The base material guiding part 34 has a curved upper surface 341 (hereinafter, referred to as a "guideway 341"). The guideway 341 is part of a cylindrical surface that centers on a virtual axis parallel to the X direction. This virtual axis is located immediately under the head unit 4 (on the −Z side). Under the head unit 4, the base material 9 moves along the smooth guideway 341. In this way, the travel path of the base material 9 curves upward toward the head unit 4 at the position opposing the head unit 4, and accordingly the base material 9 is stretched along the guideway 341. At the position opposing the head unit 4, the base material 9 moves relative to the head unit 4 along the guideway 341 in a predetermined movement direction that is roughly in the +Y direction.

On the travel path of the base material 9, a skew correction part 33 for correcting skewing of the base material 9 is provided between the supply part 31 and the base material guiding part 34, and a curing part 35 for emitting light for curing ink (in the present embodiment, ultraviolet rays) is provided between the base material guiding part 34 and the take-up part 32. Note that the inkjet printer 1 may be provided with other constituent elements such as a pre-processing part for performing predetermined pre-processing on the base material 9.

Figure 3:
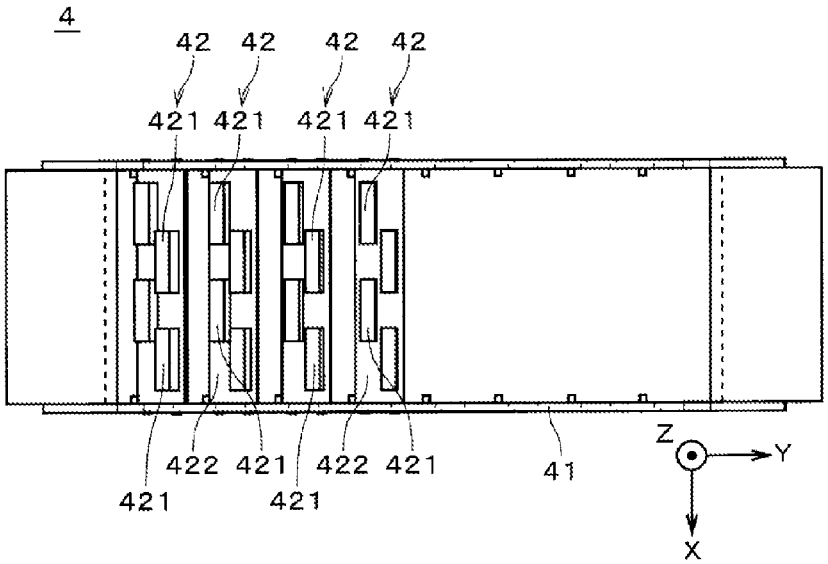
FIG. 3 is a plan view of a head unit.
Figure 4:
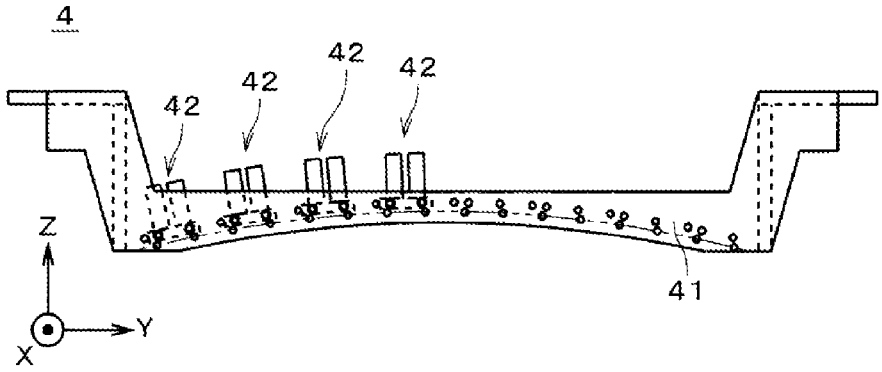
FIG. 4 is a front view of the head unit.

FIG. 3 is a plan view of the head unit 4, and FIG. 4 is a front view of the head unit 4. The head unit 4 includes a plurality of head assemblies 42 that are each long in the X direction, and a base 41 for supporting the head assemblies 42. The head assemblies 42 are arranged in substantially the Y direction (to be precise, in the aforementioned movement direction). Each of the head assemblies 42 ejects fine droplets of ink toward the base material 9.

In the present embodiment, four head assemblies 42 are mounted on the base 41. In the head unit 4, the head assemblies 42 for respectively ejecting inks of black (K), cyan (C), magenta (M), and yellow (Y) are arranged from the −Y side in the stated order. Mounted on the base 41 may be other head assemblies 42 for ejecting inks of white or specific colors, for example. Alternatively, the head assemblies 42 may eject other types of ink such as invisible ink.

The base 41 may also have, in addition to the head assemblies 42, an emitting assembly for emitting light toward the base material 9 mounted thereon. In this case, the inks ejected on the base material 9 will be pre-cured by irradiation with light (ultraviolet rays) emitted from the emitting assembly onto the base material 9. A maximum of eight assemblies including the head assemblies 42 and the emitting assembly are mountable on the base 41. The number, type, and mounting positions of the assemblies mounted on the base 41 may be appropriately changed. The maximum number of mountable assemblies on the base 41 is, however, not limited to eight.

Figure 5:
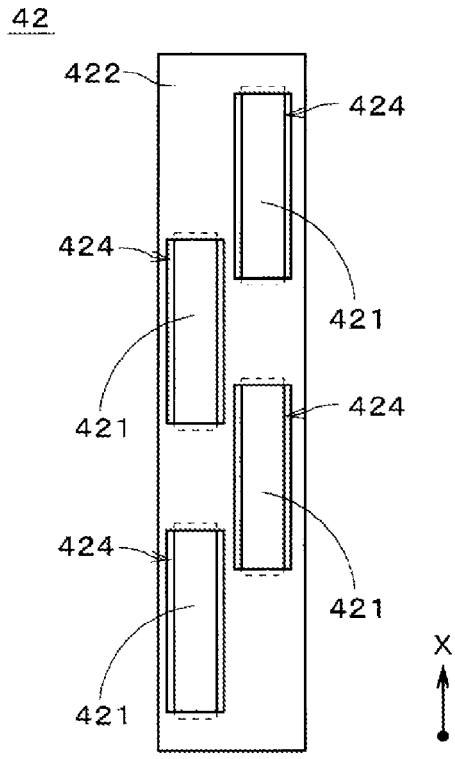
FIG. 5 is a bottom view of a head assembly.
Figure 6:
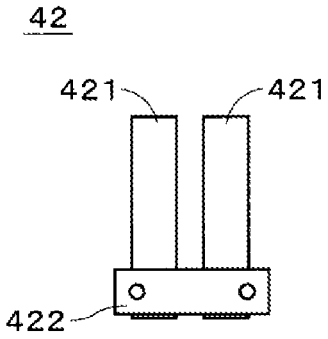
FIG. 6 is a front view of the head assembly.

FIG. 5 is a bottom view of one head assembly 42, and FIG. 6 is a front view of the head assembly 42. The following description focuses on the head assembly 42 for ejecting an ink of one color, but the other head assemblies 42 also have the same configuration. The head assembly 42 is fixed to the base 41 in an orientation in which the head assembly 42 is inclined by a slight rotation angle with respect to an axis parallel to the longitudinal direction of the head assembly 42 (X direction). Thus, strictly speaking, the lateral direction in FIG. 5 does not correspond to that in FIG. 3, and the longitudinal and lateral directions in FIG. 6 do not correspond to those in FIG. 4. The lateral directions in FIGS. 5 and 6 substantially correspond to the movement direction of the base material 9 that moves under the head assembly 42.

The head assembly 42 includes a head fixation block 422 having a substantially rectangular parallelepiped shape that is long in the X direction, and a plurality of ejection heads 421 that are each long in the X direction. In the present embodiment, four ejection heads 421 are mounted on the head fixation block 422. The head fixation block 422 is a head holding part for holding a plurality of ejection heads 421. By mounting the ejection heads 421 on the head fixation block 422, the relative positions of the ejection heads 421 are fixed, and so are the positions of the ejection heads 421 relative to the head fixation block 422.

The head fixation block 422 is formed of, for example, metal such as stainless steel. The head fixation block 422 has a plurality of through holes 424 arranged in a staggered configuration in the longitudinal direction. The ejection heads 421 are fixed to the head fixation block 422 in such a way that their lower ends (i.e., their ends on the −Z side) are respectively inserted in the through holes 424. Accordingly, the ejection heads 421 are arranged in a staggered configuration on the head fixation block 422. The opposite ends of each of the ejection heads 421 in the longitudinal direction (X direction) are secured by screws or the like to the upper surface of the head fixation block 422.

Each of the ejection heads 421 has, in its lower end surface, namely, a head lower surface, a plurality of outlets arranged along its length, i.e., in the X direction. The head assembly 42 has a larger number of outlets arranged at a substantially constant pitch along its length, i.e., in the X direction, over the entire range from the vicinity of one end of the head fixation block 422 to the vicinity of the other end. In the following description, the X direction is referred to as an "arrangement direction." The arrangement direction is substantially perpendicular to the aforementioned movement direction. Note that the arrangement direction does not necessarily have to be perpendicular to the movement direction as long as it intersects the movement direction.

In the head unit 4, the head lower surfaces of a plurality of ejection heads 421 in each of the head assemblies 42 are substantially parallel to the main surface of the base material 9 on the guideway 341. In other words, the ejection heads 421 are in upright positions relative to the base material 9. Fine droplets of ink are ejected from the outlets of the respective ejection heads 421 toward the main surface of the base material 9 in a direction substantially perpendicular to that main surface. In the case of recording an image onto the base material 9, a head elevating mechanism (not shown) lowers the head unit 4 toward the guideway 341 so as to bring the head lower surfaces of the respective ejection heads 421 close to the main surface of the base material 9.

Figure 7:
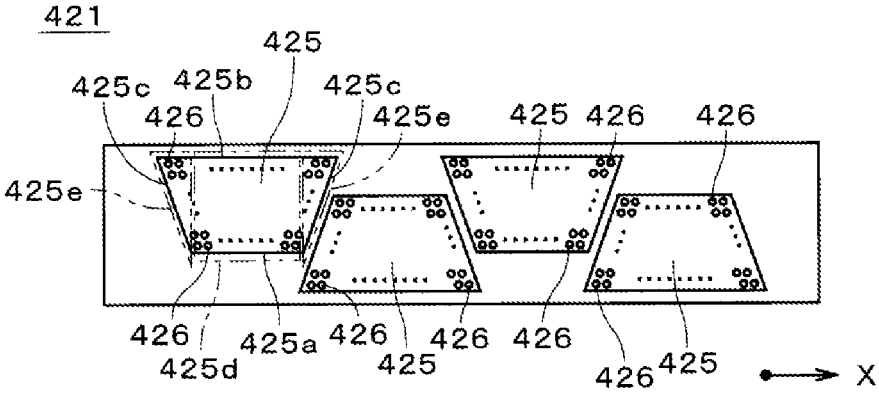
FIG. 7 is a bottom view of a head.

FIG. 7 is a bottom view of one ejection head 421. The ejection head 421 includes a plurality of head elements 425 each having a substantially isosceles trapezoid shape. In the present embodiment, four head elements 425 are arranged along the length of the ejection head 421, i.e., in the X direction. Focusing on two head elements 425 that are adjacent to each other in the X direction, their two oblique sides (legs) 425*c* adjacent to each other with a predetermined gap are parallel to each other. Also, each two adjacent head elements 425 are disposed at positions that are slightly shifted from each other in a direction perpendicular to the X direction (i.e., in a direction along the width of the ejection head 421 and corresponding to the movement direction of the base material 9).

Each of the head elements 425 has a plurality of outlets 426 arranged two-dimensionally over substantially the entire surface of the head element 425. For convenience of illustration, only some of the outlets 426 are shown in FIG. 7. The outlets 426 are shown on a scale greater than the actual size. In each of the head elements 425, a plurality of outlets 426 are disposed at positions that are slightly shifted from one another in the arrangement direction.

In each of the head elements 425, the distance between each two outlets 426 adjacent in the arrangement direction is the same in a central region 425*d* (enclosed by a dashed double-dotted line) that has a rectangular shape and that is sandwiched between a short side 425*a* of the substantially isosceles trapezoid and a portion of a long side 425*b* that faces the short side 425*a*. In other words, each of the head elements 425 has a plurality of outlets 426 arranged at a predetermined arrangement pitch in the arrangement direction. In two end regions 425*e* of the head element 425 each having a right triangular shape and located on each side of the central region 425*d* (i.e., regions each sandwiched by an oblique side 425*c* and part of the long side 425*b* and enclosed by a dashed double-dotted line), a plurality of outlets 426 are arranged at a lower density in the arrangement direction than in the central region 425*d*. Note that in FIG. 7, only the central region 425*d* and end regions 425*e* of one of the head elements 425 are indicated by dashed double-dotted lines.

In the ejection head 421, the end regions 425*e* of each two adjacent head elements 425 overlap with each other in the aforementioned movement direction perpendicular to the arrangement direction, except in the opposite end portions of the ejection head 421 in the X direction. In a region where two end regions 425*e* overlap with each other in the movement direction, a plurality of outlets 426 of the two end regions 425*e* are disposed so as to interpolate positions in the arrangement direction where there are no outlets 426 in the end regions 425*e*. Accordingly, a plurality of outlets 426 are also arranged at a predetermined arrangement pitch in the arrangement direction in a region where two end regions 425*e* overlap with each other.

In the +X-side end region 425*e* of the head element 425 that is disposed furthest to the +X side and in the −X-side end region 425*e* of the head element 425 that is disposed furthest to the −X side, a plurality of outlets 426 are sparsely arranged in the arrangement direction. Specifically, in these two end regions 425*e*, the number of outlets 426 per predetermined unit length in the arrangement direction is smaller than that in the other regions. Hereinafter, these two end regions 425*e* out of the portion of the ejection head 421 where a plurality of outlets 426 are arranged are referred to as "sparsely arranged portions," and a portion between the sparsely arranged portions, i.e., a portion in which a plurality of outlets 426 are arranged at the aforementioned arrangement pitch in the arrangement direction is referred to as a "densely arranged portion."

Figure 8:
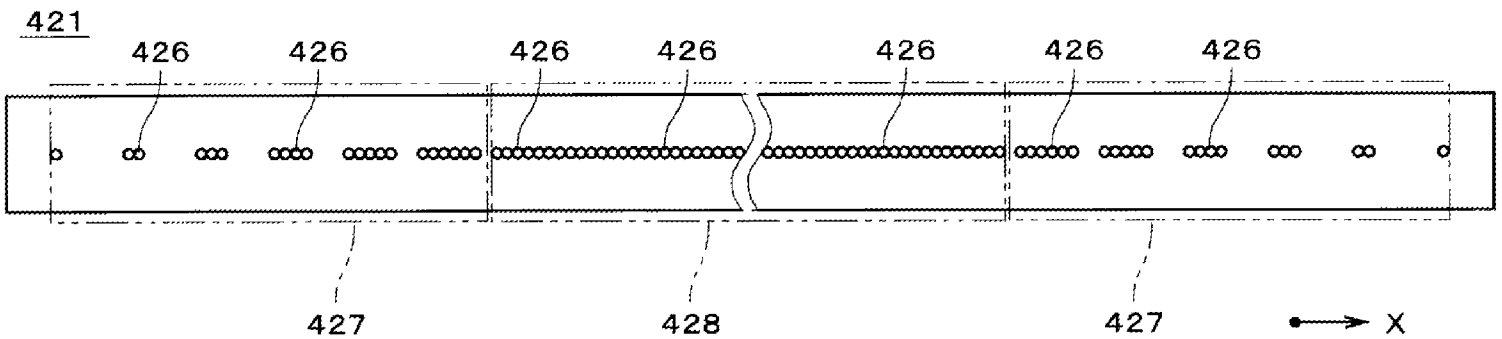
FIG. 8 is a bottom view schematically showing the arrangement of outlets of a head in an arrangement direction.

FIG. 8 is a bottom view schematically showing the arrangement of a plurality of outlets 426 of the ejection head 421 shown in FIG. 7 in the arrangement direction. In FIG. 8, a plurality of outlets 426 that are actually arranged two-dimensionally are linearly aligned in the arrangement direction on the basis of the positions of the respective outlets 426 in the arrangement direction. Two sparsely arranged portions 427 are disposed adjacent to one and the other sides of a densely arranged portion 428 in the arrangement direction. In each of the sparsely arranged portions 427, a plurality of outlets 426 are more sparsely arranged in the arrangement direction than in the densely arranged portion 428. In FIG. 8, the sparsely arranged portions 427 and the densely arranged portion 428 are each enclosed by a dashed double-dotted line.

As shown in FIG. 5, a pair of ejection heads 421 on the right side and a pair of ejection heads 421 on the left side are disposed at different positions in the lateral direction (i.e., the movement direction of the base material 9). Also, the two ejection heads 421 on the right side and the two ejection heads 421 on the left side are each alternately arranged in the arrangement direction, i.e., the X direction. An end portion of each ejection head 421 on one side in the arrangement direction overlaps in the movement direction of the base material 9 with an end portion of an adjacent ejection head 421 on the other side in the arrangement direction. In other words, the two ejection heads 421 on the right side in FIG. 5 are disposed at positions that are respectively shifted from the two ejection heads 421 on the left side in FIG. 5 in the arrangement direction.

Figure 9:
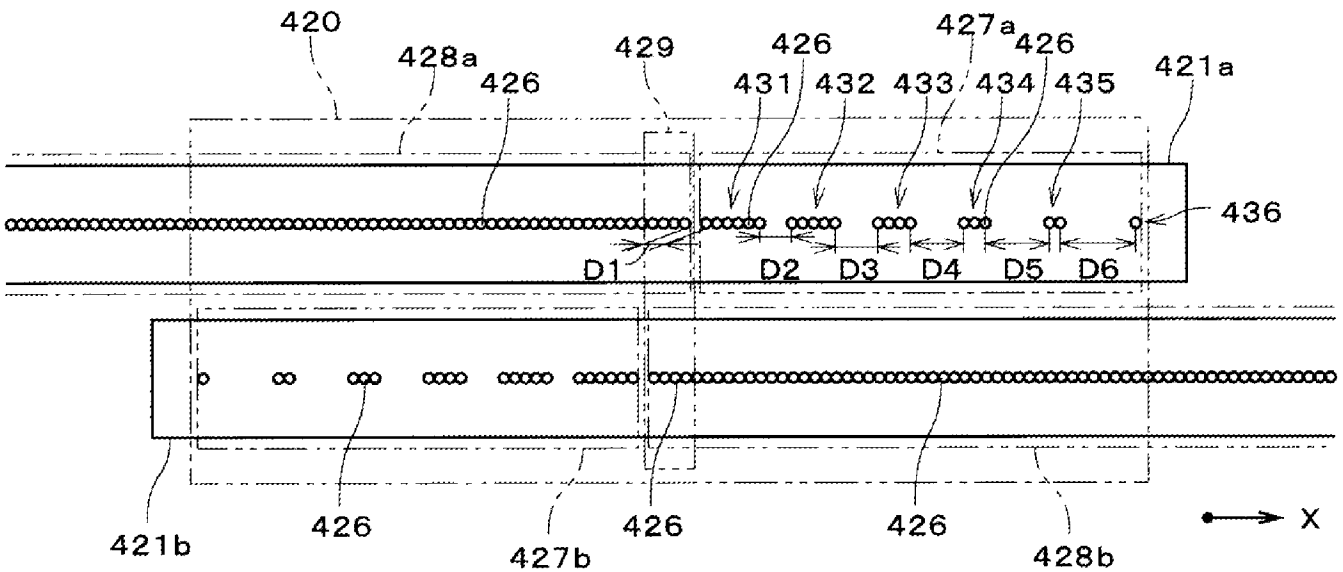
FIG. 9 is a bottom view showing the vicinity of end portions of two heads.

FIG. 9 is a bottom view showing the vicinity of the end portions of two ejection heads 421 that are adjacent to each other in the arrangement direction in FIG. 5. As for the other pairs of ejection heads 421, the arrangement in the vicinity of end portions is the same as in FIG. 9. Similarly to FIG. 8, FIG. 9 schematically shows the respective heads in which a plurality of outlets 426 are linearly arranged in the arrangement direction (the same applies to other similar drawings such as FIG. 10). In the following description, the head located on the upper side in FIG. 9 is referred to as a "first ejection head 421*a*" and the head located on the lower side is referred to as a "second ejection head 421*b*." The first ejection head 421*a* and the second ejection head 421*b* are also collectively referred to as the "ejection heads 421."

Figure 10:
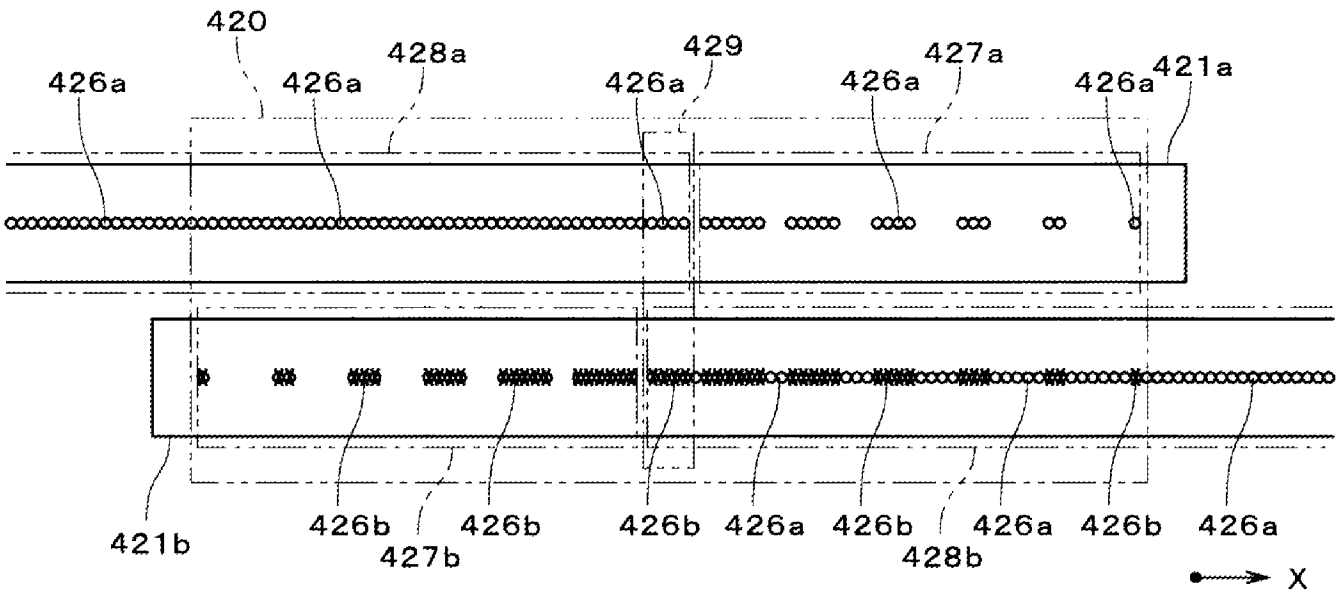
FIG. 10 illustrates the arrangement of use outlets and non-use outlets.

A sparsely arranged portion and a densely arranged portion of the first ejection head 421*a* are respectively referred to as a "first sparsely arranged portion 427*a*" and a "first densely arranged portion 428*a*," and a sparsely arranged portion and a densely arranged portion of the second ejection head 421*b* are respectively referred to as a "second sparsely arranged portion 427*b*" and a "second densely arranged portion 428*b*." In FIG. 9, the first sparsely arranged portion 427*a*, the first densely arranged portion 428*a*, the second sparsely arranged portion 427*b*, and the second densely arranged portion 428*b* are each enclosed by a dashed double-dotted line (the same applies to other similar drawings such as FIG. 10).

As shown in FIG. 9, the first sparsely arranged portion 427*a* entirely overlaps in the movement direction with part of the second densely arranged portion 428*b*. A plurality of outlets 426 in the first sparsely arranged portion 427*a* respectively overlap in the movement direction with a plurality of outlets 426 in the second densely arranged portion 428*b* (i.e., they are located at the same position in the arrangement direction).

In the present embodiment, the first sparsely arranged portion 427*a* includes 21 outlets 426. In the first sparsely arranged portion 427*a*, the 21 outlets 426 are divided into six outlet groups 431 to 436 that are aligned from the −X side to the +X side in the arrangement direction. The numbers of outlets 426 included in the outlet groups 431 to 436 are respectively six, five, four, three, two, and one. In the outlet groups 431 to 435 each including a plurality of outlets 426, the outlets 426 are arranged at the aforementioned arrangement pitch in the arrangement direction.

A distance D1 in the arrangement direction between the first densely arranged portion 428*a* and the outlet group 431 located furthest to the −X side is two times the arrangement pitch. Distances D2, D3, D4, D5, and D6 in the arrangement direction between each adjacent two of the outlet groups from the −X side to the +X side are respectively three times, four times, five times, six times, and seven times the arrangement pitch. The distance D1 is a distance in the arrangement direction between the center of the outlet 426 disposed furthest to the +X side of the first densely arranged portion 428*a* and the center of the outlet 426 disposed furthest to the −X side of the outlet group 431. The distance D2 is a distance in the arrangement direction between the center of the outlet 426 disposed furthest to the +X side of the outlet group 431 and the center of the outlet 426 disposed furthest to the −X side of the outlet group 432 that is the second group from the −X side. The same applies to the distances D3 to D6.

In the first sparsely arranged portion 427*a*, the number of outlets per unit length in the arrangement direction decreases as the distance in the arrangement direction from the first densely arranged portion 428*a* increases. The unit length is equal to a length obtained by multiplying the arrangement pitch by a number (i.e., 7) that is obtained by adding one to the number of outlets 426 (i.e., 6) included in the outlet group 431 that includes the largest number of outlets 426 in the first sparsely arranged portion 427*a*, that is, it is equal to seven times the arrangement pitch. The unit length may be longer than the above length (i.e., seven times the arrangement pitch).

A portion of the first densely arranged portion 428*a* in the vicinity of the first sparsely arranged portion 427*a* overlaps in the movement direction with a portion of the second densely arranged portion 428*b* in the vicinity of the second sparsely arranged portion 427*b*. Hereinafter, the range in the arrangement direction in which a portion of the first densely arranged portion 428*a* and a portion of the second densely arranged portion 428*b* overlap with each other in the movement direction is referred to as a "dense overlapping range 429." In FIG. 9, the dense overlapping range 429 is enclosed by a dashed double-dotted line (the same applies to other similar drawings such as FIG. 10). In the dense overlapping range 429, a plurality of outlets 426 of the first densely arranged portion 428*a* respectively overlap in the movement direction with a plurality of outlets 426 of the second densely arranged portion 428*b* (i.e., they are located at the same position in the arrangement direction). In the present embodiment, the dense overlapping range 429 includes four outlets 426 of the first densely arranged portion 428*a* and four outlets 426 of the second densely arranged portion 428*b*. Note that the number of outlets 426 in each of the first densely arranged portion 428*a* and the second densely arranged portion 428*b* included in the dense overlapping range 429 may be one, or it may be two or more.

The second sparsely arranged portion 427*b* entirely overlaps in the movement direction with a portion of the first densely arranged portion 428*a*. A plurality of outlets 426 of the second sparsely arranged portion 427*b* respectively overlap in the movement direction with a plurality of outlets 426 of the first densely arranged portion 428*a*. The arrangement of a plurality of outlets 426 in the second sparsely arranged portion 427*b* is the same as that in the aforementioned first sparsely arranged portion 427*a*. In the second sparsely arranged portion 427*b*, the number of outlets per unit length described above in the arrangement direction decreases as the distance in the arrangement direction from the second densely arranged portion 428*b* increases.

In the following description, a range in which the end portions of two ejection heads 421 overlap with each other in the movement direction is referred to as an "overlapping range 420," and each two outlets 426 that overlap with each other in the movement direction is referred to as an "overlapping outlet pair." In FIG. 9, the overlapping range 420 is enclosed by a dashed double-dotted line (the same applies to other similar drawings such as FIG. 10). In the head assembly 42, a plurality of overlapping outlet pairs are arranged in the arrangement direction in each overlapping range 420. In the present embodiment, the overlapping range 420 includes 21 overlapping outlet pairs that respectively include the 21 outlets 426 of the first sparsely arranged portion 427*a*, four overlapping outlet pairs of the dense overlapping range 429, and 21 overlapping outlet pairs that respectively include the 21 outlets 426 of the second sparsely arranged portion 427*b*.

Note that two outlets 426 that overlap with each other in the movement direction do not necessarily have to be located at strictly the same position in the direction (in the present embodiment, the arrangement direction) perpendicular to the movement direction, and they may be located at somewhat different positions in the arrangement direction. In this case, one outlet 426 of the first ejection head 421*a* and one outlet 426 of the second ejection head 421*b* that is located at a position closest to the outlet 426 of the first ejection head 421*a* in the arrangement direction are assumed to substantially overlap with each other in the movement direction.

In the present embodiment, out of the two outlets 426 in each overlapping outlet pair, only one outlet 426 is used in recording an image onto the base material 9, and the other outlet 426 is not used. Hereinafter, outlets 426 that are used in recording an image onto the base material 9 are referred to as "use outlets" and outlets 426 that are not used in recording an image onto the base material 9 are referred to as "non-use outlets." In the overlapping range 420, among the outlets of one of the ejection heads 421, those that do not overlap in the movement direction with any of the outlets of the other ejection head 421 are use outlets. Among the outlets 426 of the first densely arranged portion 428*a* and the second densely arranged portion 428*b*, those that are not included in the overlapping range 420 are all used in recording an image onto the base material 9.

FIG. 10 shows the arrangement of use outlets and non-use outlets of the first ejection head 421*a* and the second ejection head 421*b* in the overlapping range 420 and the vicinity thereof shown in FIG. 9. In FIG. 10, the use outlets are denoted by 426*a*, and the non-use outlets are denoted by 426*b* and marked with a cross. As shown in FIG. 10, in the overlapping range 420, a plurality of outlets 426 of the first sparsely arranged portion 427*a* are all use outlets 426*a*. Among a plurality of outlets 426 of the second densely arranged portion 428*b*, those that overlap in the movement direction with the use outlets 426*a* of the first sparsely arranged portion 427*a* are non-use outlets 426*b*, and those that do not overlap in the movement direction with the outlets of the first sparsely arranged portion 427*a* are use outlets 426*a*.

Out of each overlapping outlet pair in the dense overlapping range 429, as described above, one outlet is a use outlet 426*a* and the other outlet is a non-use outlet 426*b*. In the present embodiment, a plurality of outlets of the first densely arranged portion 428*a* are all use outlets 426*a*, and a plurality of outlets of the second densely arranged portion 428*b* are all non-use outlets 426*b*. Note that, in the dense overlapping range 429, the use outlet 426*a* in each overlapping outlet pair may be either the outlet of the first densely arranged portion 428*a* or the outlet of the second densely arranged portion 428*b*. In the second sparsely arranged portion 427*b*, the outlets are all non-use outlets 426*b*.

Note that all of the outlets of the first sparsely arranged portion 427*a* do not necessarily have to be use outlets 426*a*, and it is sufficient that the outlets of the first sparsely arranged portion 427*a* include use outlets 426*a*. For example, among the outlets of the first sparsely arranged portion 427*a*, some outlets may be use outlets 426*a* and the other outlets may be non-use outlets 426*b*. In this case, among the outlets of the second densely arranged portion 428*b*, those that overlap in the movement direction with the use outlets 426*a* of the first sparsely arranged portion 427*a* are non-use outlets 426*b*, and those that overlap in the movement direction with the non-use outlets 426*b* of the first sparsely arranged portion 427*a* and those that do not overlap in the movement direction with any of the outlets of the first sparsely arranged portion 427*a* are use outlets 426*a*.

In the image forming processing of the inkjet printer 1 shown in FIG. 1, continuous portions of the base material 9 are sequentially drawn out from the supply part 31, and each of the portions (hereinafter, referred to as a "target portion") passes through the skew correction part 33 and reaches the base material guiding part 34. In the base material guiding part 34, the target portion moves in the movement direction while remaining in contact with the guideway 341, and the head unit 4 opposing the base material guiding part 34 records an image onto the target portion. Specifically, the four head assemblies 42 for respectively ejecting inks of K, C, M, and Y record color images of K, C, M, and Y onto the target portion. Thereafter, the target portion moves to the curing part 35, in which the inks are cured, and is then taken up by the take-up part 32. This completes the image formation on the target portion.

In each of the head assemblies 42, the outlets 426 (see FIG. 7) are arranged in the direction perpendicular to the movement direction across the entire width of an image recording region of the base material 9. In the inkjet printer 1, the recording of an image onto the base material 9 is completed in one pass of the base material 9 under the head unit 4 by the recording control part 83 (see FIG. 2) controlling the conveying mechanism 2 and the head unit 4. In other words, an image is recorded onto the base material 9 by the base material 9 moving only once in the movement direction relative to the head unit 4. In this way, the inkjet printer 1 that implements so-called single pass printing allows an image to be formed in a short time.

Incidentally, at the time of assembly of the head assembly 42 shown in FIG. 5, a plurality of ejection heads 421 are mounted on the head fixation block 422 as described above. The ejection heads 421 to be mounted each need to be positioned with high accuracy such that outlets 426 of each two ejection heads 421 adjacent to each other in the arrangement direction are arranged at a predetermined arrangement pitch in the overlapping range 420. However, there is a limit to the accuracy of alignment of the ejection heads 421 because inkjet printers where high resolution is required have a very small alignment pitch. There are thus cases where the mounting positions of the ejection heads 421 are displaced from design mounting positions in the arrangement direction.

Figure 11:
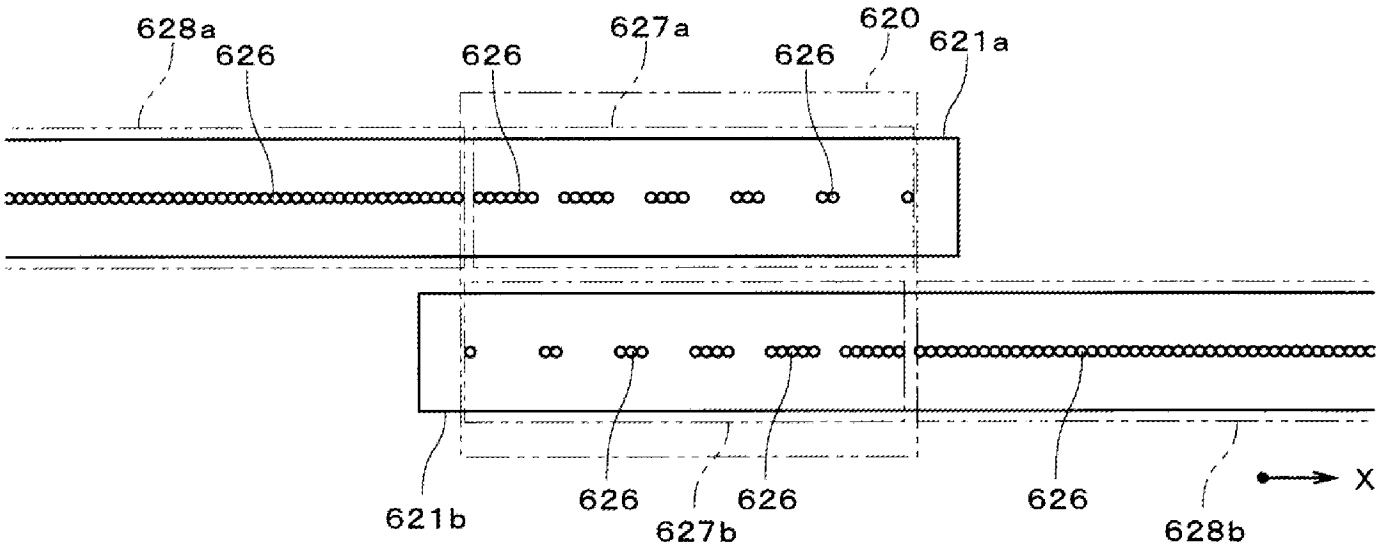
FIG. 11 is a bottom view showing the vicinity of end portions of two heads of an inkjet printer according to a comparative example.

Here, as a comparative example, an inkjet printer is considered in which a first ejection head 621*a* and a second ejection head 621*b* that respectively have the same structures as the first ejection head 421*a* and the second ejection head 421*b* are arranged such that a first sparsely arranged portion 627*a* and a second sparsely arranged portion 627*b* overlap with each other in the movement direction as shown in FIG. 11. In an overlapping range 620 in FIG. 11, outlets 626 of the first sparsely arranged portion 627*a* and outlets 626 of the second sparsely arranged portion 627*b* are arranged at such an arrangement pitch as to mutually interpolate one another in the arrangement direction, and the outlets 626 in the overlapping range 620 are all used in image recording. The overlapping range 620 does not include outlets 626 of the first densely arranged portion 628*a* and the second densely arranged portion 628*b*.

Figure 12:
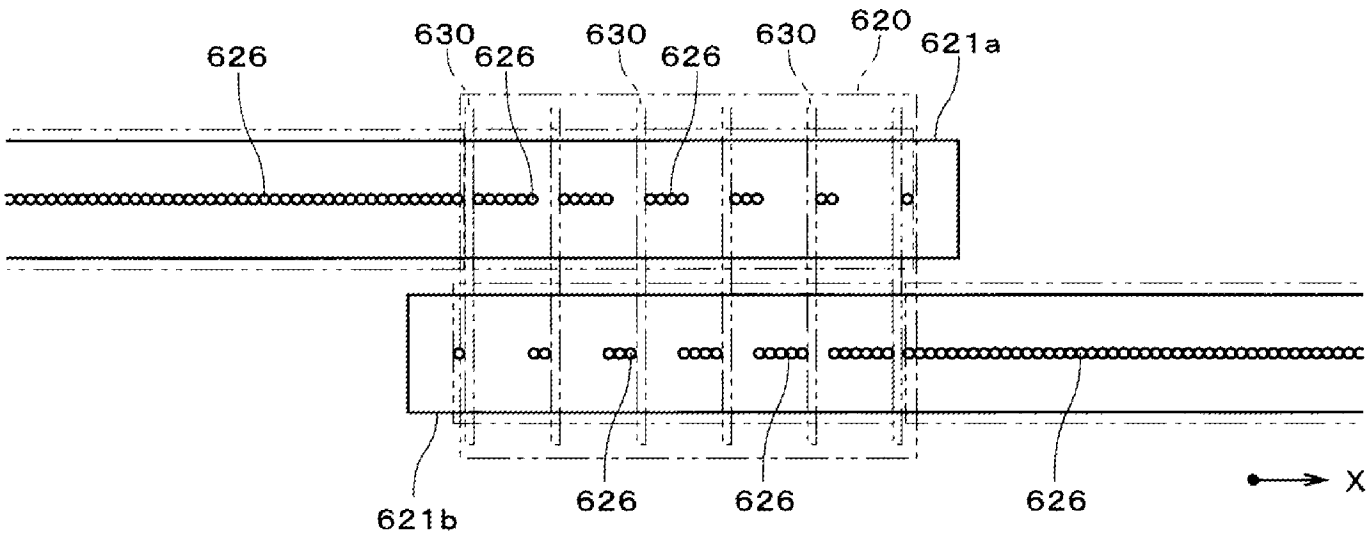
FIG. 12 is a bottom view showing the vicinity of end portions of two heads of an inkjet printer of a comparative example.

In the inkjet printer of the comparative example, if, for example, the mounting position of the first ejection head 621*a* is displaced to the +X side by a distance equal to the arrangement pitch, a plurality of no-outlet ranges 630, each extending in the movement direction and in which there are neither the outlets 626 of the first ejection head 621*a* nor the outlets 626 of the second ejection head 621*b*, will appear in the overlapping range 620 as shown in FIG. 12. If the inkjet printer of the comparative example in this state is used in image recording, no image is recorded on regions of the base material corresponding to the no-outlet ranges 630, and a plurality of strip-shaped voids extending in the movement direction of the base material appear in these regions. If the mounting position of the first ejection head 621*a* is displaced to the +X side by a distance greater than the arrangement pitch, the width of the voids will increase. The same can be said of the case in which the mounting position of the first ejection head 621*a* is displaced to the −X side. In this way, the inkjet printer of the comparative example will generate streaky unevenness in the overlapping range 620 due to displacement of the mounting position of an ejection head.

Figure 13:
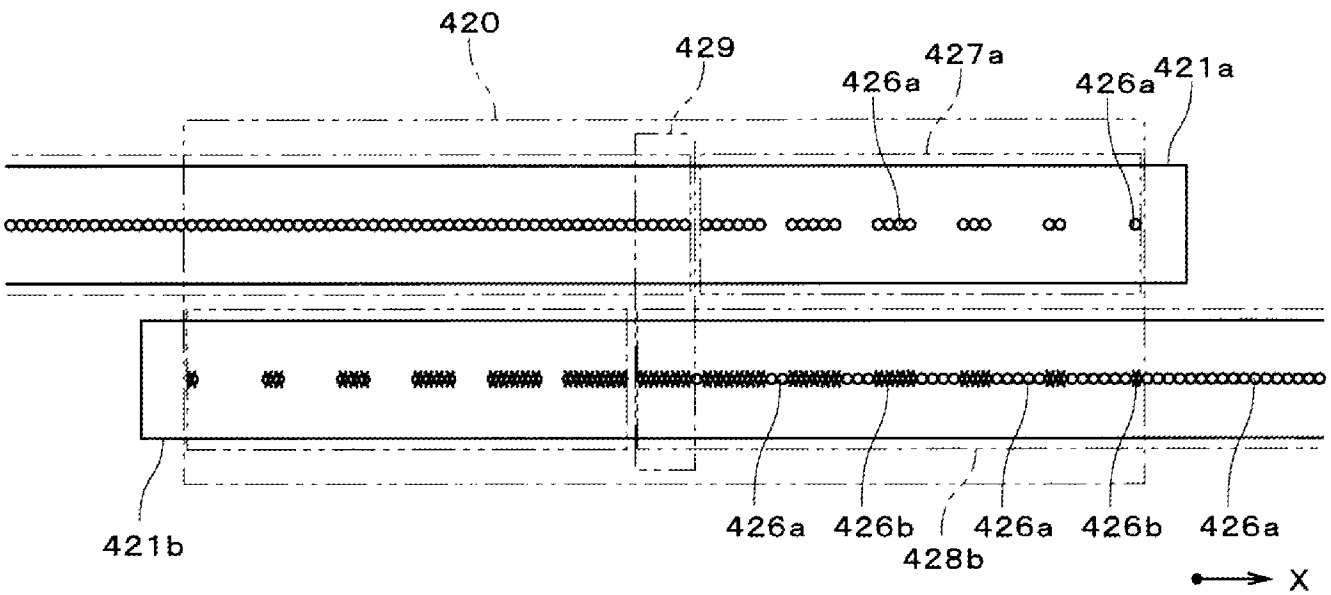
FIG. 13 is a bottom view showing the vicinity of end portions of two heads.

In contrast, in the inkjet printer 1 according to the present embodiment, the first sparsely arranged portion 427*a* entirely overlaps in the movement direction with the second densely arranged portion 428*b* and the second sparsely arranged portion 427*b* entirely overlaps in the movement direction with the first densely arranged portion 428*a* as shown in FIGS. 9 and 10. Accordingly, even if the mounting position of the first ejection head 421*a* is displaced to, for example, the +X side by a distance equal to the arrangement pitch, the inkjet printer 1 can prevent the occurrence of voids such as in the inkjet printer of the comparative example by switching the use or non-use of a plurality of outlets of the second densely arranged portion 428*b* in the overlapping range 420 as shown in FIG. 13. The first ejection head 421*a* and the second ejection head 421*b* shown in FIG. 13 each include five outlets 426 in the dense overlapping range 429.

Specifically, the outlets of the first sparsely arranged portion 427*a* include use outlets 426*a*, and among the outlets of the second densely arranged portion 428*b*, those that overlap in the movement direction with the use outlets 426*a* of the first sparsely arranged portion 427*a* are determined as non-use outlets 426*b*. Among the outlets of the second densely arranged portion 428*b*, those that do not overlap in the movement direction with the outlets of the first sparsely arranged portion 427*a* are determined as use outlets 426*a*. If the first sparsely arranged portion 427*a* includes non-use outlets 426*b*, among the outlets of the second densely arranged portion 428*b*, those that overlap in the movement direction with the non-use outlets 426*b* of the first sparsely arranged portion 427*a* are also determined as use outlets 426*a*. This prevents or suppresses the occurrence of voids in the image recorded on the base material 9.

Incidentally, in an inkjet printer that records images using a plurality of ejection heads arranged in the arrangement direction, even if an image having the same density is recorded with the respective ejection heads, the density of the recorded image may be slightly different for each ejection head due to factors such as differences in the mechanical properties of the ejection heads. If, in the overlapping range of two ejection heads adjacent in the arrangement direction, the outlets that are used in image recording are completely switched at a certain switching position in the arrangement direction, that is, only outlets of one of the ejection head are used on one side of the switching position and only outlets of the other ejection head are used on the other side of the switching position, streaky unevenness due to changes in the density of the image at the switching position become noticeable.

In view of this, the inkjet printer 1 uses both of the outlets of the first ejection head 421*a* and the outlets of the second ejection head 421*b* in the overlapping range 420 when recording an image onto the base material 9. Thus, the image recorded with the ink ejected from the first ejection head 421*a* and the image recorded with the ink ejected from the second ejection head 421*b* are mixed in the region of the base material 9 corresponding to the overlapping range 420. Consequently, it is possible to reduce the possibility that changes in the density of an image due to, for example, different mechanical properties of the ejection heads will be recognized by someone viewing the image.

In this way, the inkjet printer 1 prevents or suppresses a reduction in print quality (i.e., a reduction in the quality of image recording) such as the occurrence of voids or changes in density in the overlapping range 420 of two ejection heads 421 adjacent to each other in the arrangement direction. Note that the switching of the use or non-use of each outlet may also be performed on the first sparsely arranged portion 427*a*. Even in the case where the mounting position of the first ejection head 421*a* relative to the second ejection head 421*b* is displaced to the +X or −X side by a distance greater than the arrangement pitch, the inkjet printer 1 can, as described above, prevent or suppress a reduction in print quality in the overlapping range 420 of two ejection heads 421 adjacent to each other in the arrangement direction.

If the amount of displacement in the mounting position of the first ejection head 421*a* relative to the second ejection head 421*b* is not an integral multiple of the arrangement pitch (e.g., 0.5 times the arrangement pitch), there is a possibility that slight voids will occur in the overlapping range 420 or that fine streaky unevenness darker than the surroundings will occur in the overlapping range 420 due to some of the use outlets 426*a* of the first ejection head 421*a* and the second ejection head 421*b* overlapping with one another in the movement direction. However, because, as described above, changes in the density of the image are unlikely to be recognized in the region of the base material 9 corresponding to the overlapping range 420, it is possible to reduce the possibility of such slight voids or dark streaky unevenness being recognized.

As described above, in the first sparsely arranged portion 427*a* shown in FIG. 10, the number of outlets per unit length in the arrangement direction decreases as the distance in the arrangement direction from the first densely arranged portion 428*a* increases. Thus, in the overlapping range 420, as the distance from the first densely arranged portion 428*a* increases, the number of use outlets 426*a* of the first ejection head 421*a* per unit length decreases and the number of use outlets 426*a* of the second ejection head 421*b* increases. This consequently causes gradual changes in density in the overlapping range 420 and further reduces the possibility of such changes in density being recognized by someone viewing the image.

Since the outlets of the first sparsely arranged portion 427*a* are all use outlets 426*a*, it is possible to easily determine the use or non-use of outlets in the first sparsely arranged portion 427*a* and in the portion of the second densely arranged portion 428*b* that overlaps with the first sparsely arranged portion 427*a*. Moreover, since the outlets of the second sparsely arranged portion 427*b* are all non-use outlets 426*b*, it is possible to easily determine the use or non-use of outlets in the second sparsely arranged portion 427*b* and in the portion of the first densely arranged portion 428*a* that overlaps with the second sparsely arranged portion 427*b*.

In the inkjet printer 1, part of the first densely arranged portion 428*a* and part of the second densely arranged portion 428*b* overlap with each other in the movement direction in the dense overlapping range 429, and out of each overlapping outlet pair in the dense overlapping range 429, one outlet is a use outlet 426*a* and the other outlet is a non-use outlet 426*b*. It is thus possible to further suppress the occurrence of voids in the vicinity of the boundary between the first densely arranged portion 428*a* and the first sparsely arranged portion 427*a* as compared with the case in which the first densely arranged portion 428*a* and the second densely arranged portion 428*b* do not overlap with each other in the movement direction.

As described above, the inkjet printer 1 can prevent or suppress a reduction in print quality in the overlapping range 420 of two ejection heads 421 that are adjacent to each other in the arrangement direction. The structure of the inkjet printer 1 is thus particularly suitable for use as a single-pass inkjet printer in which streaky unevenness in the overlapping range 420 are relatively noticeable.

In the manufacture (or maintenance) of the inkjet printer 1, after the assembly of the head assemblies 42, test image recording is performed on a test base material. The result of recording on the test base material is input to the control part 8. In the control part 8, the ejection management part 82 determines the use or non-use of the outlets 426 in the overlapping range 420 on the basis of the result of recording performed on the test base material and information stored in advance in the storage part 81 shown in FIG. 2. The test base material may be part of the aforementioned base material 9 in continuous sheet form or may be another base material different from the base material 9.

The aforementioned information stored in the storage part 81 is relationship information indicating a relationship between a plurality of overlapping states of the outlets 426 of the first ejection head 421*a* and the outlets 426 of the second ejection head 421*b* in the movement direction in the overlapping range 420, and use states of outlets that respectively correspond to the overlapping states. The relationship information is set in advance and stored in storage part 81 as described below, prior to the aforementioned test image recording.

The relationship information includes a relationship between a plurality of overlapping states and use states of the outlets of the first sparsely arranged portion 427*a* that respectively correspond to the overlapping states. The overlapping states include, for example, the desired overlapping state shown in FIGS. 9 and 10, that is, the design overlapping state. The overlapping states also include an overlapping state in which the ejection heads 421 are shifted from the design overlapping state in the arrangement direction as shown in FIG. 13. The overlapping states also include various overlapping states that are shifted from the design overlapping state.

A use state of outlets is information indicating which of a plurality of outlets of the first sparsely arranged portion 427*a* are determined as use outlets 426*a* in one overlapping state of the first ejection head 421*a* and the second ejection head 421*b*. The use state of outlets is determined for each of the overlapping states by an operator. For example, the design overlapping state shown in FIG. 10 is associated with a use state in which the outlets 426 of the first sparsely arranged portion 427*a* are all used. The overlapping state shown in FIG. 13 is also associated with the use state in which the outlets 426 of the first sparsely arranged portion 427*a* are all used. The above relationship information is stored in, for example, table form in the storage part 81.

The relationship information further includes a relationship between the aforementioned plurality of overlapping states and use states of the outlets of the first densely arranged portion 428*a* in the dense overlapping range 429, the use states respectively corresponding to the overlapping states. For example, the design overlapping state shown in FIG. 10 is associated with a use state in which the four outlets 426 of the first densely arranged portion 428*a* in the dense overlapping range 429 are all used. The overlapping state shown in FIG. 13 is associated with a condition of use in which the five outlets 426 of the first densely arranged portion 428*a* in the dense overlapping range 429 are all used.

The relationship information further includes a relationship between the aforementioned plurality of overlapping states and use states of the outlets of the second sparsely arranged portion 427*b* that respectively correspond to the overlapping states. For example, the design overlapping state shown in FIG. 10 is associated with a use state in which the outlets 426 of the second sparsely arranged portion 427*b* are all not used. The overlapping state shown in FIG. 13 is also associated with a use state in which the outlets 426 of the second sparsely arranged portion 427*b* are all not used.

In the case of determining the use or non-use of the outlets 426, as described previously, an overlapping state of a plurality of outlets 426 of the first ejection head 421*a* and a plurality of outlets 426 of the second ejection head 421*b* is obtained on the basis of the result of the test image recording performed on the test base material. Then, on the basis of the obtained overlapping state and the aforementioned relationship information, the ejection management part 82 determines the use or non-use of each outlet 426 of the first sparsely arranged portion 427*a*, the first densely arranged portion 428*a* in the dense overlapping range 429, and the second sparsely arranged portion 427*b*.

Subsequently, the ejection management part 82 determines, among the outlets 426 of the second densely arranged portion 428*b*, the use or non-use of each outlet 426 that overlaps in the movement direction with the first sparsely arranged portion 427*a*. Specifically, in the second densely arranged portion 428*b*, the outlets 426 that overlap in the movement direction with the outlets 426 of the first sparsely arranged portion 427*a* are determined as non-use outlets if the outlets 426 of the first sparsely arranged portion 427*a* are used, and determined as use outlets if the outlets 426 of the first sparsely arranged portion 427*a* are not used. On the other hand, outlets 426 that do not overlap in the movement direction with the outlets 426 of the first sparsely arranged portion 427*a* are all used.

The ejection management part 82 also determines, among the outlets 426 of the second densely arranged portion 428*b*, the use or non-use of each outlet 426 that overlaps in the movement direction with the first densely arranged portion 428*a* in the dense overlapping range 429. Specifically, in the dense overlapping range 429, if an outlet 426 of the first densely arranged portion 428*a* is used, the outlet 426 of the second densely arranged portion 428*b* that overlaps in the movement direction with this outlet 426 of the first densely arranged portion 428*a* is not used, and if the outlet 426 of the first densely arranged portion 428*a* is not used, the outlet 426 of the second densely arranged portion 428*b* that overlaps in the movement direction with that outlet 426 of the first densely arranged portion 428*a* is used.

The ejection management part 82 further determines, among the outlets 426 of the first densely arranged portion 428*a*, the use or non-use of each outlet 426 that overlaps in the movement direction with the second sparsely arranged portion 427*b*. Specifically, in the first densely arranged portion 428*a*, an outlet 426 that overlaps in the movement direction with an outlet 426 of the second sparsely arranged portion 427*b* is not used if the outlet 426 of the second sparsely arranged portion 427*b* is used, whereas it is used if the outlet 426 of the second sparsely arranged portion 427*b* is not used. On the other hand, outlets 426 that do not overlap in the movement direction with any of the outlets 426 of the second sparsely arranged portion 427*b* are all used.

In recording an image onto the base material 9, fine droplets of ink are ejected toward the base material 9 from those outlets 426 that have been determined as use outlets on the basis of the determination as to the use or non-use by the ejection management part 82. In this way, the inkjet printer 1 using the ejection management part 82 can automatically determine the use or non-use of the outlets 426 in accordance with an actual overlapping state that may be different from the design overlapping state. In addition, setting all of the outlets of the first sparsely arranged portion 427*a* as use outlets 426*a* facilitates the determination of the ejection management part 82 as to the use or non-use of the outlets 426. Setting all of the outlets of the second sparsely arranged portion 427*b* as non-use outlets 426*b* further facilitates the determination of the ejection management part 82 as to the use or non-use of each outlet 426.

Next is a description of an inkjet printer according to a second embodiment of the present invention. The inkjet printer according to the second embodiment has the same structure as the inkjet printer 1 shown in FIG. 1, and in the following description, corresponding constituent elements are denoted by the same reference numerals. In the inkjet printer according to the second embodiment, the size of fine droplets of ink ejected from each outlet 426 of each ejection head 421 (i.e., a first ejection head 421*a* and a second ejection head 421*b*) is changeable among three types, namely, a "large size," a "medium size," and a "small size."

By changing the size of fine droplets of ink, the inkjet printer can change the size of dots to be recorded on the base material 9 with the fine droplets of ink. Dots that are recorded with fine droplets of ink of the large size are the largest dots that can be represented by the inkjet printer. Dot that are recorded with fine droplets of ink of the small size are the smallest dots that can be represented by the inkjet printer. Dots that are recorded with fine droplets of ink of the medium size are smaller than the largest dots and larger than the smallest dots. In the following description, dots that are recorded on the base material 9 with fine droplets of ink of the large size, the medium size, and the small size are respectively referred to as "large dots," "medium dots," and "small dots."

Figure 14:
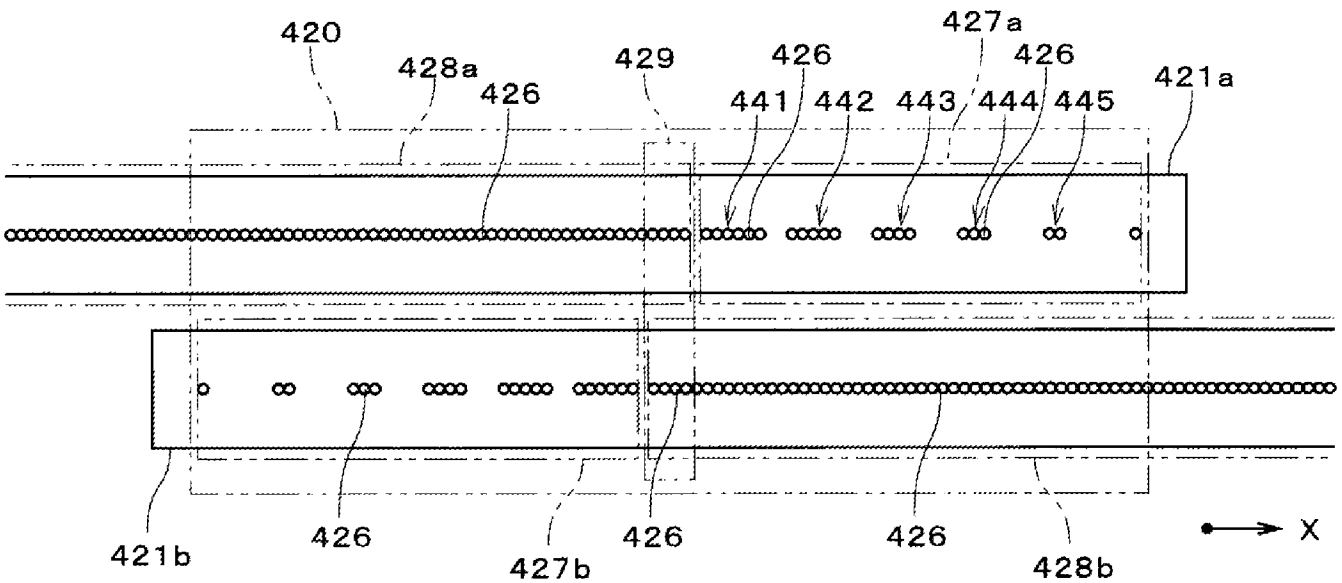
FIG. 14 is a bottom view showing the vicinity of end portions of two heads of an inkjet printer according to a second embodiment.

FIG. 14 is a bottom view similar to FIG. 9 showing the vicinity of the end portions of two ejection heads 421 (i.e., a first ejection head 421*a* and a second ejection head 421*b*) that are adjacent to each other in the arrangement direction. An overlapping range 420 shown in FIG. 14 includes, similarly to the overlapping range 420 shown in FIG. 9, 21 overlapping outlet pairs that respectively include 21 outlets 426 of a first sparsely arranged portion 427*a*, four overlapping outlet pairs in a dense overlapping range 429, and 21 overlapping outlet pairs that respectively include 21 outlets 426 of a second sparsely arranged portion 427*b*.

In the case of recording an image onto the base material 9, out of each of the 21 overlapping outlet pairs respectively including the 21 outlets 426 of the second sparsely arranged portion 427*b*, i.e., the overlapping outlet pairs corresponding to the second sparsely arranged portion 427*b*, only one outlet 426 is used in image recording and the other outlet 426 is not used. Also, out of each of the 21 overlapping outlet pairs respectively including the 21 outlets 426 of the first sparsely arranged portion 427*a*, i.e., the overlapping outlet pairs corresponding to the first sparsely arranged portion 427*a*, image recording mainly uses one of the outlets 426 and the other outlet 426 is used in an auxiliary manner. Similarly, out of each of the four overlapping outlet pairs in the dense overlapping range 429, image recording mainly uses one of the outlets 426 and the other outlet 426 is used in an auxiliary manner.

Hereinafter, outlets that are used in image recording out of the overlapping outlet pairs corresponding to the second sparsely arranged portion 427*b*, and outlets that are mainly used in image recording out of the overlapping outlet pairs corresponding to the first sparsely arranged portion 427*a* and the overlapping outlet pairs in the dense overlapping range 429 are referred to as "use outlets." Also, outlets that are not used in image recording out of the overlapping outlet pairs corresponding to the second sparsely arranged portion 427*b* are referred to as "non-use outlets." Also, outlets that are used in an auxiliary manner in image recording out of the overlapping outlet pairs corresponding to the first sparsely arranged portion 427*a* and the overlapping outlet pairs in the dense overlapping range 429 are referred to as "auxiliary outlets." In the overlapping range 420, among the outlets of one of the ejection heads 421, those that do not overlap in the movement direction with any of the outlets of the other ejection head 421 are use outlets that are used in recording an image onto the base material 9. Among the outlets 426 of the first densely arranged portion 428*a* and the second densely arranged portion 428*b*, those that are not included in the overlapping range 420 are all use outlets that are used in recording an image onto the base material 9.

Figure 15:
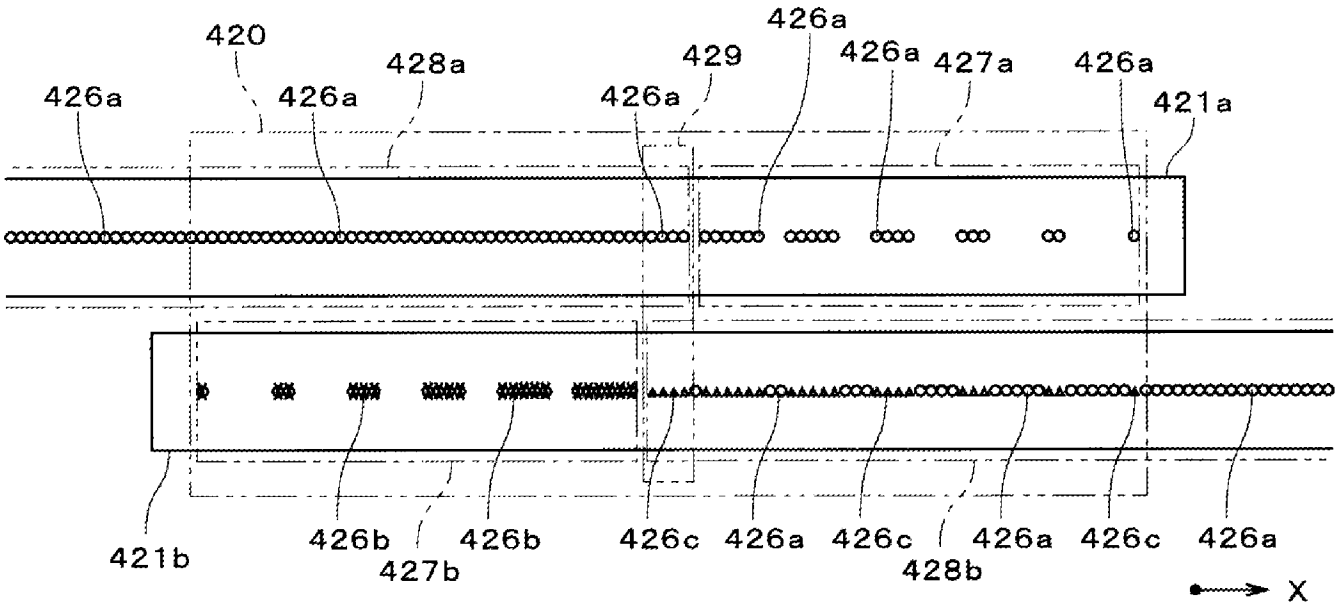
FIG. 15 illustrates the arrangement of use outlets, non-use outlets, and auxiliary outlets.

FIG. 15 illustrates the arrangement of use outlets, non-use outlets, and auxiliary outlets of the first ejection head 421*a* and the second ejection head 421*b* in the overlapping range 420 and the vicinity thereof shown in FIG. 14. In FIG. 15, the use outlets are denoted by 426*a*, and the non-use outlets are denoted by 426*b* and marked with a cross. The auxiliary outlets are indicated by triangles denoted by 426*c*. The same applies to FIGS. 17 to 24. As shown in FIG. 15, in the overlapping range 420, a plurality of outlets of the first sparsely arranged portion 427*a* are all use outlets 426*a*. Among the outlets 426 of the second densely arranged portion 428*b*, those that overlap in the movement direction with the use outlets 426*a* of the first sparsely arranged portion 427*a* are auxiliary outlets 426*c*, and those that do not overlap in the movement direction with the use outlets 426*a* of the first sparsely arranged portion 427*a* are use outlets 426*a*.

Out of each overlapping outlet pair in the dense overlapping range 429, as described above, one outlet is a use outlet 426*a* and the other outlet is an auxiliary outlet 426*c*. In the present embodiment, the outlets of the first densely arranged portion 428*a* are all use outlets 426*a*, and the outlets of the second densely arranged portion 428*b* are all auxiliary outlets 426*c*. Note that, in the dense overlapping range 429, the use outlet 246*a* of each overlapping outlet pair may be either the outlet of the first densely arranged portion 428*a* or the outlet of the second densely arranged portion 428*b*. In the second sparsely arranged portion 427*b*, the outlets are all non-use outlets 426*b*. Among the outlets of the first densely arranged portion 428*a*, those that are located on the −X side of the dense overlapping range 429 are all use outlets 426*a*.

Note that all of the outlets of the first sparsely arranged portion 427*a* do not necessarily have to be use outlets 426*a*, and it is sufficient that the outlets of the first sparsely arranged portion 427*a* include use outlets 426*a*. For example, among the outlets of the first sparsely arranged portion 427*a*, some outlets may be use outlets 426*a* and the other outlets may be auxiliary outlets 426*c*. In this case, among the outlets of the second densely arranged portion 428*b*, those that overlap in the movement direction with the use outlets 426*a* of the first sparsely arranged portion 427*a* are auxiliary outlets 426*c*, and those that overlap in the movement direction with the auxiliary outlets 426*c* of the first sparsely arranged portion 427*a* and those that do not overlap in the movement direction with any of the outlets of the first sparsely arranged portion 427*a* are use outlets 426*a*.

Incidentally, in the inkjet printer 1 according to the first embodiment, if the amount of displacement in the mounting position of the first ejection head 421*a* relative to the second ejection head 421*b* is not an integral multiple of the arrangement pitch, as described above, positional displacement of less than the arrangement pitch will remain even after the displacement in the mounting position is corrected by determining the use or non-use of each outlet 426, and there is a possibility of the occurrence of slight voids in the overlapping range 420 due to this remaining positional displacement. In the following description, such positional displacement remaining after the displacement in the mounting position has been corrected by determining the use or non-use of each outlet 426 as described above is referred to as a "post-correction positional displacement."

Figure 16:
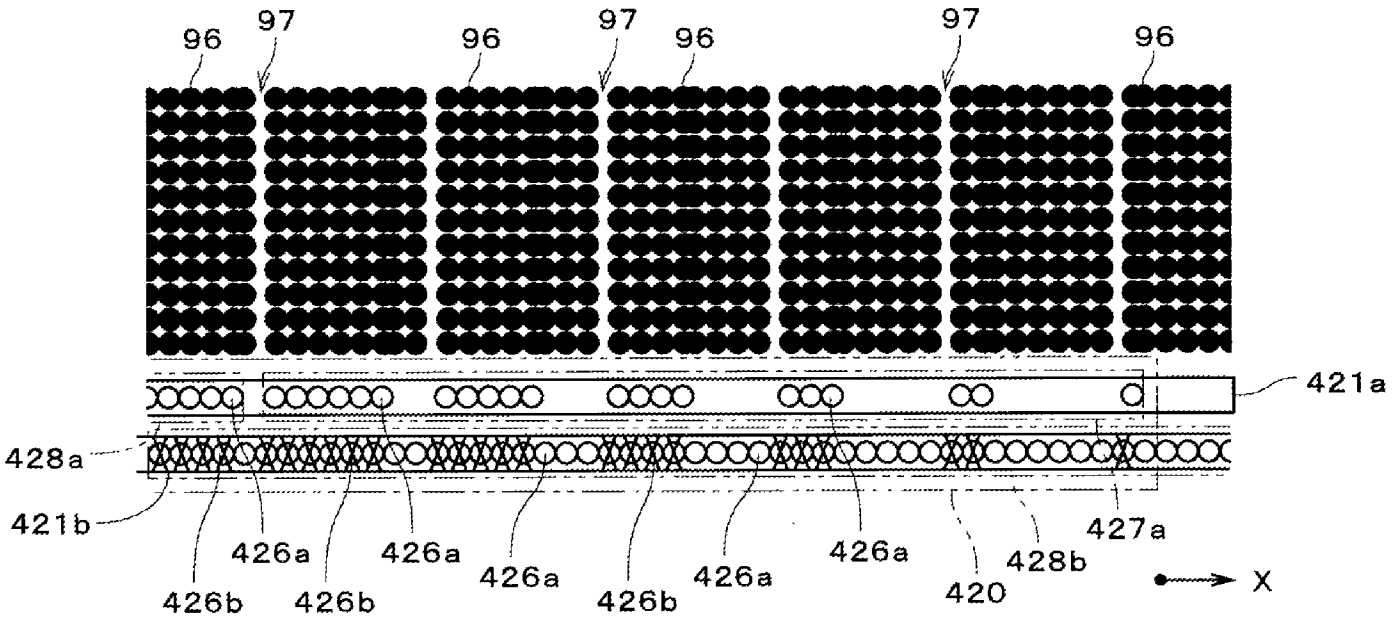
FIGS. 16 to 20 illustrate dots formed on a base material.

FIG. 16 illustrates dots 96 formed on the base material 9 by some of the outlets 426 in the overlapping range 420 of the inkjet printer 1. In FIG. 16, a plurality of dots 96 recorded on the base material 9 are indicated by solid circles, and the outlets 426 of the first ejection head 421*a* and the second ejection head 421*b* used in recording the dots 96 are schematically illustrated below the dots 96. FIG. 16 shows use outlets 426*a* of the first sparsely arranged portion 427*a* and the first densely arranged portion 428*a*, and use outlets 426*a* and non-use outlets 426*b* of the second densely arranged portion 428*b*. In FIG. 16, gaps formed between the dots 96 due to the aforementioned post-correction positional displacement form a continuous sequence in the movement direction of the base material 9 (i.e., the vertical direction in FIG. 16), thereby producing voids 97. Such slight voids 97 are not easily recognized on the base material 9 as described above, but there is still a possibility that they will be recognized.

On the other hand, when recording an image onto the base material 9 using the inkjet printer of the second embodiment, in each of the head assemblies 42 in which the use or non-use of the outlets have been determined in advance using the same method as described in the first embodiment, which of the use outlets 426*a* shown in FIG. 15 to eject fine droplets of ink from is changed in accordance with image data (i.e., in accordance with the gradation values of pixels in the image data corresponding to dot recording positions on the base material 9), and in the case of ejecting ink, the size of fine droplets of ink is changed. Focusing on each overlapping outlet pair corresponding to the first sparsely arranged portion 427*a* in the overlapping range 420, if the size of fine droplets of ink ejected from the use outlet 426*a* of the first sparsely arranged portion 427*a* toward a dot recording position is greater than or equal to a predetermined size, the auxiliary outlet 426*c* of the second densely arranged portion 428*b* ejects fine droplets of ink of the small size toward the dot recording position, irrespective of the image data.

Similarly, focusing on each overlapping outlet pair in the dense overlapping range 429, if the size of fine droplets of ink ejected from the use outlet 426*a* of the first densely arranged portion 428*a* toward a dot recording position is greater than or equal to the predetermined size, the auxiliary outlet 426*c* of the second densely arranged portion 428*b* ejects fine droplets of ink of the small size to the dot recording position, irrespective of the image data. Note that, if ink is not ejected from the use outlet 426*a* of the first ejection head 421 out of each overlapping outlet pair of the first sparsely arranged portion 427*a* and each overlapping outlet pair in the dense overlapping range 429, the auxiliary outlet 426*c* also does not eject ink. The aforementioned predetermined size is one of the large size, the medium size, and the small size. The size of the fine droplets of ink ejected from the auxiliary outlet 426*c* irrespective of the image data may be the medium size.

In the inkjet printer according to the second embodiment, a combination of the aforementioned predetermined size and the size of the fine droplets of ink ejected from the auxiliary outlets 426*c* is determined in advance and stored in the storage part 81 of the control part 8 (see FIG. 2). On the basis of this combination information stored in the storage part 81, the recording control part 83 controls the conveying mechanism 2 and the head unit 4 to record an image onto the base material 9.

Figure 17:
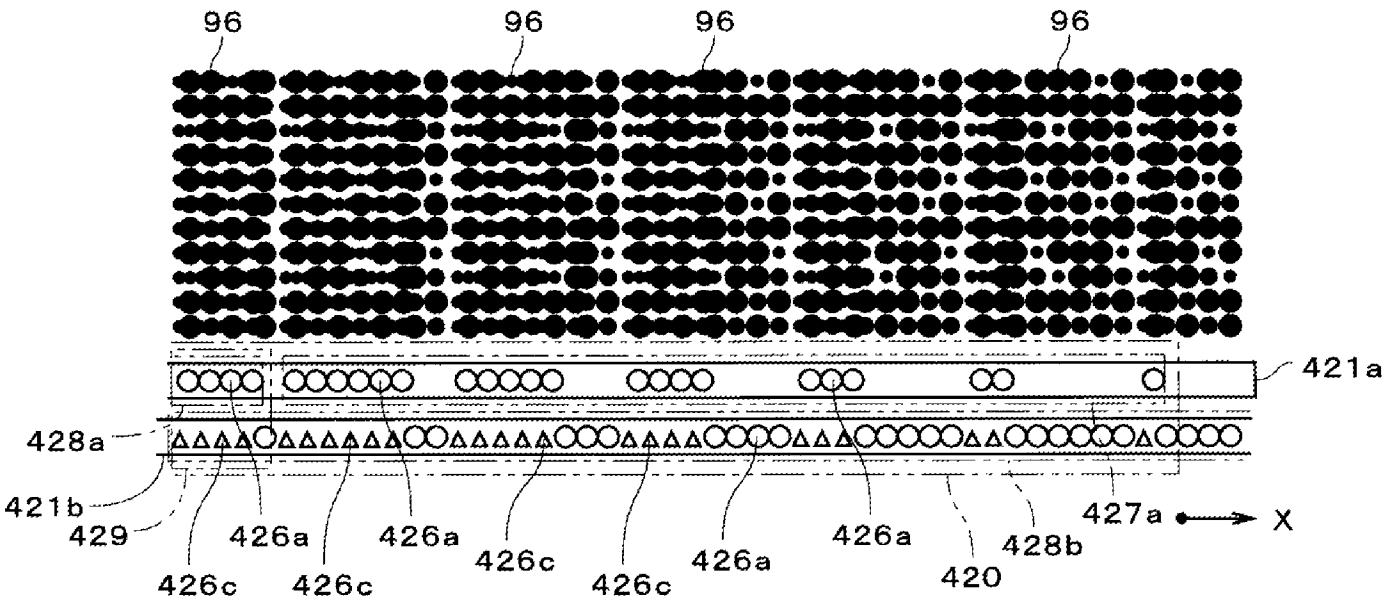

FIG. 17 illustrates dots 96 formed on the base material 9 by some of the outlets 426 in the overlapping range 420 shown in FIG. 15. FIG. 17 shows a case of the aforementioned combination in which the predetermined size is the small size and the size of the fine droplets of ink ejected from the auxiliary outlets 426*c* is the small size. Specifically, if, out of each overlapping outlet pair corresponding to the first sparsely arranged portion 427*a* and each overlapping outlet pair in the dense overlapping range 429, the use outlet 426*a* of the first ejection head 421*a* ejects fine droplets of ink of one of the large size, the medium size, and the small size, the auxiliary outlet 426*c* of the second ejection head 421*b* ejects fine droplets of ink of the small size. If ink is not ejected from the use outlet 426*a* of the first ejection head 421*a*, the auxiliary outlet 426*c* of the second ejection head 421*b* also does not eject ink.

Figure 18:
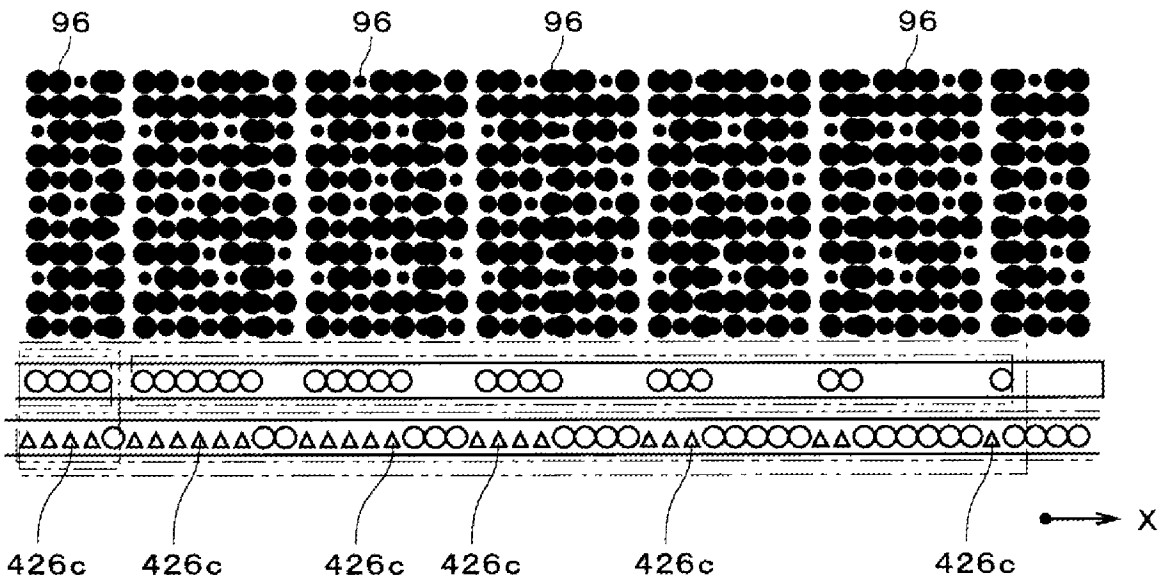

In FIG. 17, similarly to FIG. 16, a plurality of dots 96 recorded on the base material 9 are indicated by solid circles, and the outlets 426 of the first ejection head 421*a* and the second ejection head 421*b* that are used to record the dots 96 are schematically illustrated below the dots 96. FIG. 17 shows use outlets 426*a* of the first sparsely arranged portion 427*a* and the first densely arranged portion 428*a*, and use outlets 426*a* and auxiliary outlets 426*c* of the second densely arranged portion 428*b*. FIG. 18 illustrates dots 96 formed on the base material 9 when ink is not ejected from the auxiliary outlets 426*c*. The way of rendering in FIG. 18 is the same as that in FIGS. 16 and 17 (the same applies to FIGS. 19, 20, 22, and 24).

As shown in FIG. 17, in the inkjet printer of the second embodiment, if the size of fine droplets of ink ejected from the use outlets 426*a* out of each overlapping outlet pair corresponding to the first sparsely arranged portion 427*a* is greater than or equal to the small size, the auxiliary outlet 426*c* ejects ink of the small size. Accordingly, even if the amount of displacement in the mounting position of the first ejection head 421*a* relative to the second ejection head 421*b* is not an integral multiple of the arrangement pitch, it is possible to suppress the occurrence of streaky unevenness such as voids due to the aforementioned post-correction positional displacement, as compared with the case in which no ink is ejected from the auxiliary outlet 426*c* (see FIG. 18). Similarly, if the size of fine droplets of ink ejected from the use outlet 426*a* out of each overlapping outlet pair in the dense overlapping range 429 is greater than or equal to the small size, the auxiliary outlet 426*c* ejects ink of the small size. This further suppresses the occurrence of streaky unevenness.

If the inkjet printer of the second embodiment does not perform density correction, the amount of ink applied to a region (hereinafter referred to as an "auxiliary ejection region") that corresponds to the first sparsely arranged portion 427*a* and the dense overlapping range 429 on the base material 9 is greater than that applied to the other regions by the amount of the fine droplets of ink of the small size ejected from the auxiliary outlets 426*c*. Consequently, the density of the auxiliary ejection region will be higher than the desired density. In view of this, in each of the head assemblies 42, density correction that reduces the amount of ink ejected or the frequency of ink ejection from the outlets 426 that eject ink toward the auxiliary ejection region is performed in order to reduce the total amount of ink ejected toward the auxiliary ejection region by an amount of ink corresponding to the amount of ink ejected from the auxiliary outlets 426*c*. Accordingly, even the image recorded on the auxiliary ejection region has an appropriate density.

Figure 19:
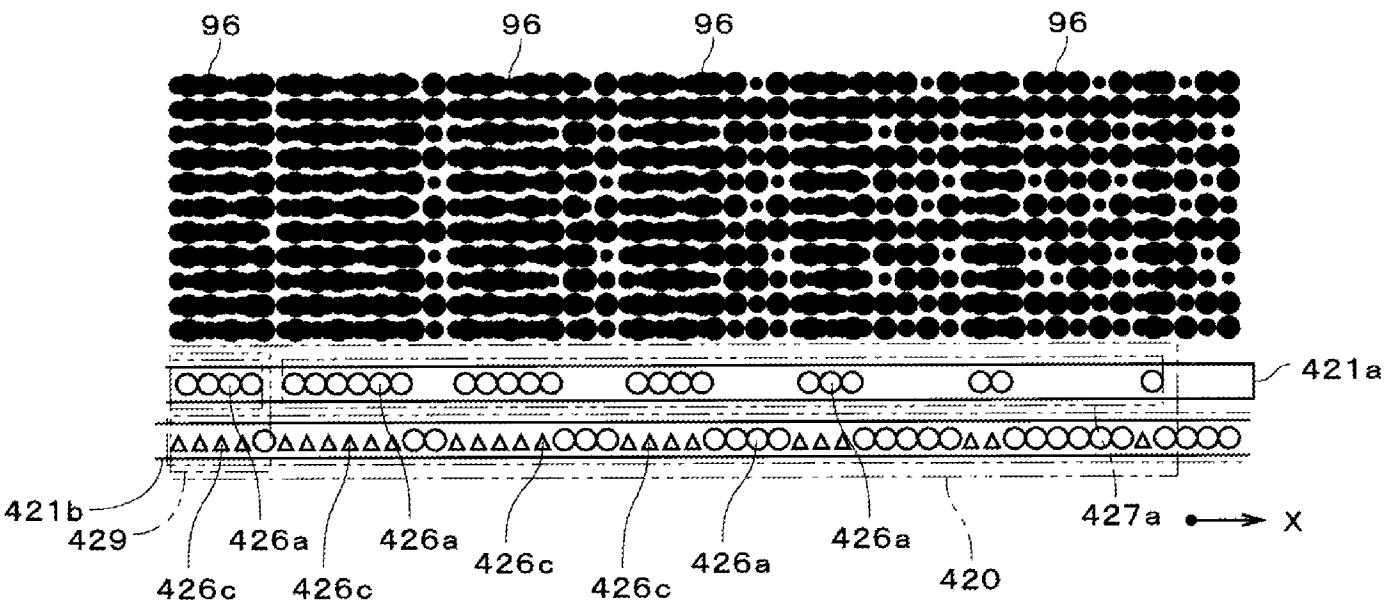
Figure 20:
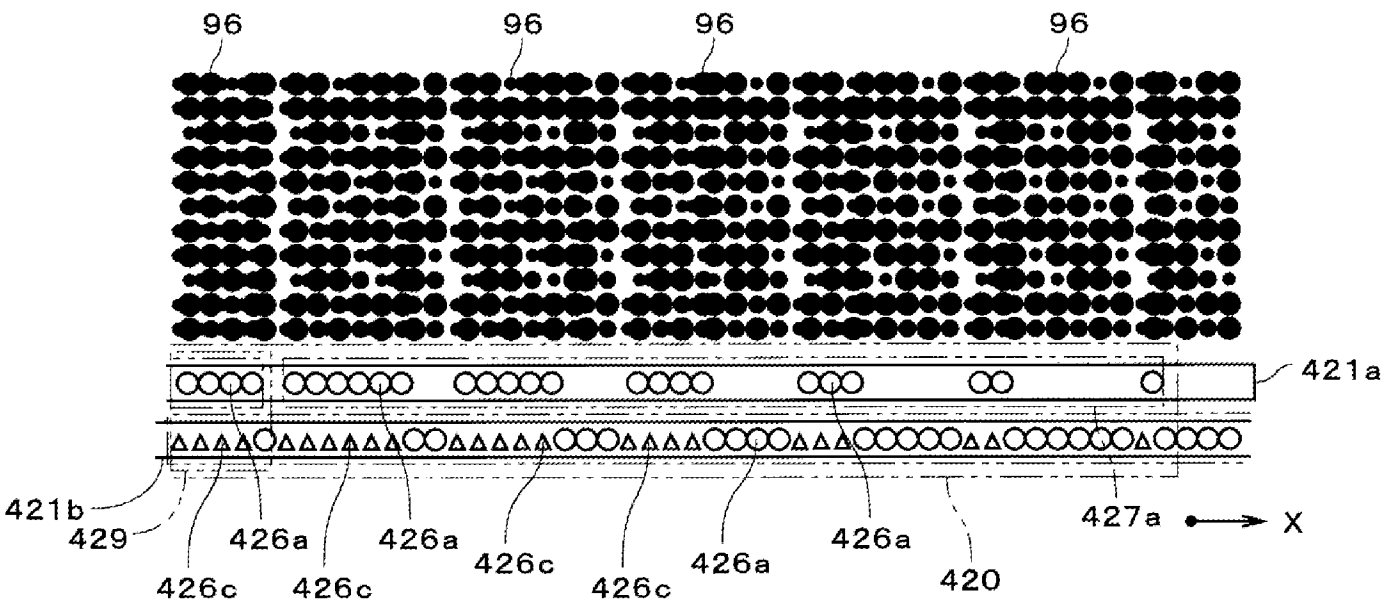

FIGS. 19 and 20 each illustrate dots 96 formed on the base material 9 by some of the outlets 426 in the overlapping range 420 when different information is stored as the aforementioned combination information in the storage part 81. In the example shown in FIG. 19, if, in each overlapping outlet pair corresponding to the first sparsely arranged portion 427*a* and each overlapping outlet pair in the dense overlapping range 429, the use outlet 426*a* of the first ejection head 421*a* ejects fine droplets of ink of one of the large size, the medium size, and the small size, the auxiliary outlet 426*c* of the second ejection head 421*b* ejects fine droplets of ink of the medium size. If ink is not ejected from the use outlet 426*a* of the first ejection head 421*a* in each of the above overlapping outlet pairs, the auxiliary outlet 426*c* also does not eject ink. This more effectively suppresses the occurrence of streaky unevenness such as voids than in the example shown in FIG. 17 when the amount of displacement in the mounting position of the first ejection head 421*a* relative to the second ejection head 421*b* is not an integral multiple of the arrangement pitch. On the other hand, this increases the total amount of ink ejected from the auxiliary outlets 426*c* to the auxiliary ejection region and accordingly increases the amount of correction required in density correction performed on the outlets 426 that eject ink toward the auxiliary ejection region.

In the example shown in FIG. 20, if, in each overlapping outlet pair corresponding to the first sparsely arranged portion 427*a* and each overlapping outlet pair in the dense overlapping range 429, the use outlet 426*a* of the first ejection head 421*a* ejects fine droplets of ink of the large size, the auxiliary outlet 426*c* of the second ejection head 421*b* ejects fine droplets of ink of the small size. If the use outlet 426*a* of the first ejection head 421*a* in each of the above overlapping outlet pairs ejects fine droplets of ink of either the medium size or the small size, or if ink is not ejected therefrom, the auxiliary outlet 426*c* does not eject ink. Although the degree of suppression is smaller than in the example shown in FIG. 17, when the amount of displacement in the mounting position of the first ejection head 421*a* relative to the second ejection head 421*b* is not an integral multiple of the arrangement pitch, the occurrence of streaky unevenness such as voids can thereby be suppressed. Also, the total amount of ink ejected from the auxiliary outlets 426*c* to the auxiliary ejection region decreases. It is thus possible to reduce the amount of correction required in density correction performed on the outlets 426 that eject ink toward the auxiliary ejection region.

As shown in FIG. 14, in the inkjet printer of the second embodiment, a plurality of outlets 426 of the first sparsely arranged portion 427*a* of the first ejection head 421*a* include use outlet rows 441 to 445 that are each a set of use outlets 426*a* (see FIG. 15) arranged at the above arrangement pitch in the arrangement direction. The numbers of use outlets 426*a* included in the use outlet rows 441 to 445 are respectively six, five, four, three, and two. Hereinafter, in each of the use outlet rows 441 to 445, two use outlets that are located at opposite ends in the arrangement direction are referred to as "end use outlets." In the first sparsely arranged portion 427*a*, a single isolated use outlet 426*a*, i.e., the use outlet 426*a* that has no other use outlets 426*a* arranged adjacent to it and at the arrangement pitch on both sides in the X direction, is also referred to as an "end use outlet." In the dense overlapping range 429, among the use outlets 426*a* of the first densely arranged portion 428*a*, the one use outlet that is located closest to the first sparsely arranged portion 427*a* is referred to as an "end use outlet."

Figure 21:
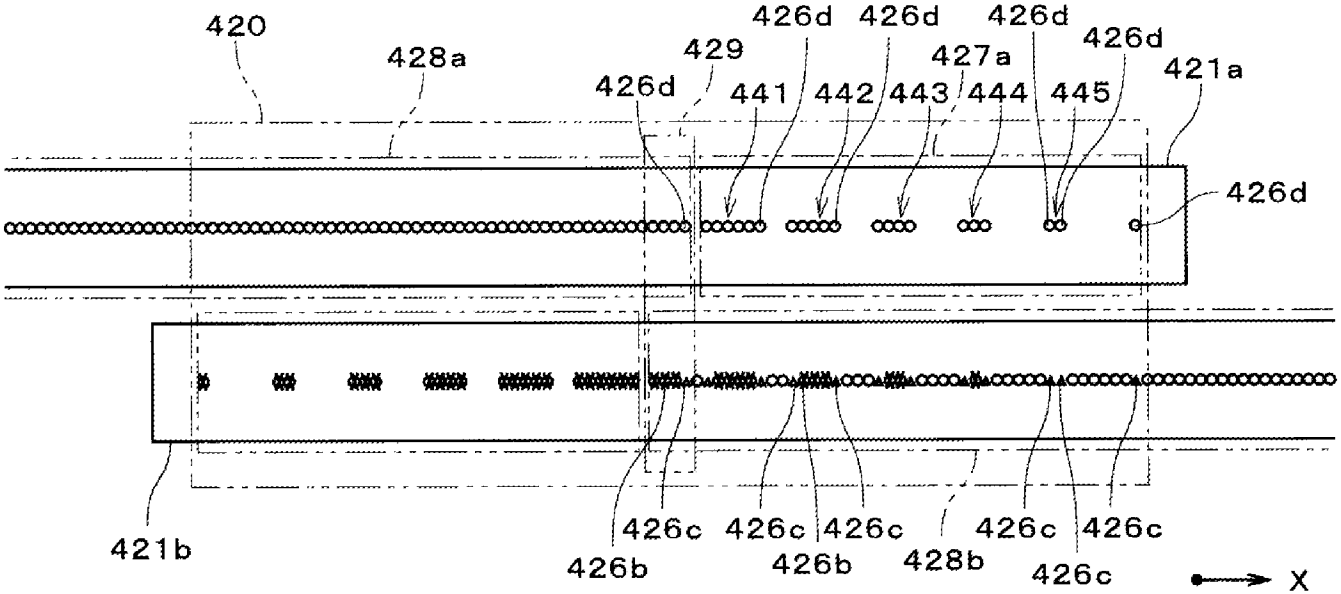
FIG. 21 illustrates the arrangement of use outlets, non-use outlets, and auxiliary outlets.

FIG. 21 illustrates the arrangement of use outlets, non-use outlets, and auxiliary outlets of the first ejection head 421*a* and the second ejection head 421*b* in the overlapping range 420 and the vicinity thereof shown in FIG. 14. The arrangement shown in FIG. 21 is different from that shown in FIG. 15. In the example shown in FIG. 21, in the second densely arranged portion 428*b* of the second ejection head 421*b*, among outlets 426 that overlap in the movement direction with the use outlet rows 441 to 445, those that overlap in the movement direction with the two end use outlets 426*d* of each of the use outlet rows 441 to 445 are auxiliary outlets 426*c*. Also among the outlets 426 in the second densely arranged portion 428*b* that overlap in the movement direction with the use outlet rows 441 to 445, the other outlets 426 excluding the above auxiliary outlets 426*c* (i.e., all the outlets 426 that do not overlap in the movement direction with the end use outlets 426*d*) are all non-use outlets 426*b* that are not used in recording an image onto the base material 9. In the dense overlapping range 429, among the outlets 426 of the second densely arranged portion 428*b*, those that overlap in the movement direction with the end use outlets 426*d* of the first densely arranged portion 428*a* are auxiliary outlets 426*c*, and the other outlets 426 are all non-use outlets 426*b*.

In the example shown in FIG. 21, in the overlapping outlet pairs that include the end use outlets 426*d* and the auxiliary outlets 426*c* among the overlapping outlet pairs corresponding to the first sparsely arranged portion 427*a* and the overlapping outlet pair in the dense overlapping range 429, if the size of fine droplets of ink ejected from the end use outlets 426*d* toward dot recording positions is greater than or equal to a predetermined size, the auxiliary outlets 426*c* eject fine droplets of ink of either the small size or the medium size toward the dot recording positions, irrespective of the image data, as in the example shown in FIG. 15. The predetermined size is one of the large size, the medium size, and the small size as in the example shown in FIG. 15.

Figure 22:
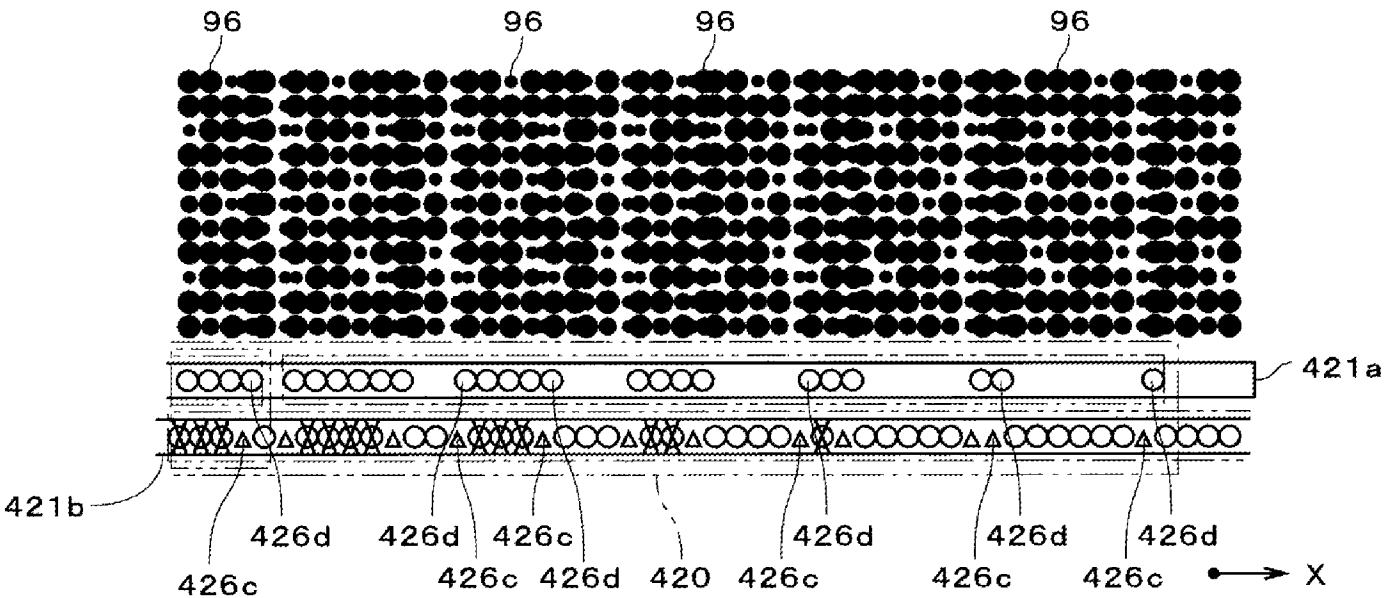
FIG. 22 illustrates dots formed on the base material.

FIG. 22 illustrates dots 96 formed on the base material 9 by some of the outlets 426 in the overlapping range 420 shown in FIG. 21. In the example shown in FIG. 22, the predetermined size and the size of fine droplets of ink ejected from the auxiliary outlets 426*c* are both the small size as in the example shown in FIG. 17. In other words, if the size of fine droplets of ink ejected from the end use outlets 426*d* toward dot recording positions is one of the large size, the medium size, and the small size, the auxiliary outlets 426*c* eject fine droplets of ink of the small size. If ink is not ejected from the end use outlets 426*d*, the auxiliary outlets 426*c* also do not eject ink.

In the example shown in FIG. 22, it is possible to suppress the occurrence of streaky unevenness such as voids to the same degree as in the example shown in FIG. 17 even if the amount of displacement in the mounting position of the first ejection head 421*a* relative to the second ejection head 421*b* is not an integral multiple of the arrangement pitch. Also, the total amount of ink ejected from the auxiliary outlets 426*c* to the auxiliary ejection region of the base material 9 is smaller than in the example shown in FIG. 17. It is thus possible to reduce the amount of correction required in density correction performed on the outlets 426 that eject ink toward the auxiliary ejection region.

Figure 23:
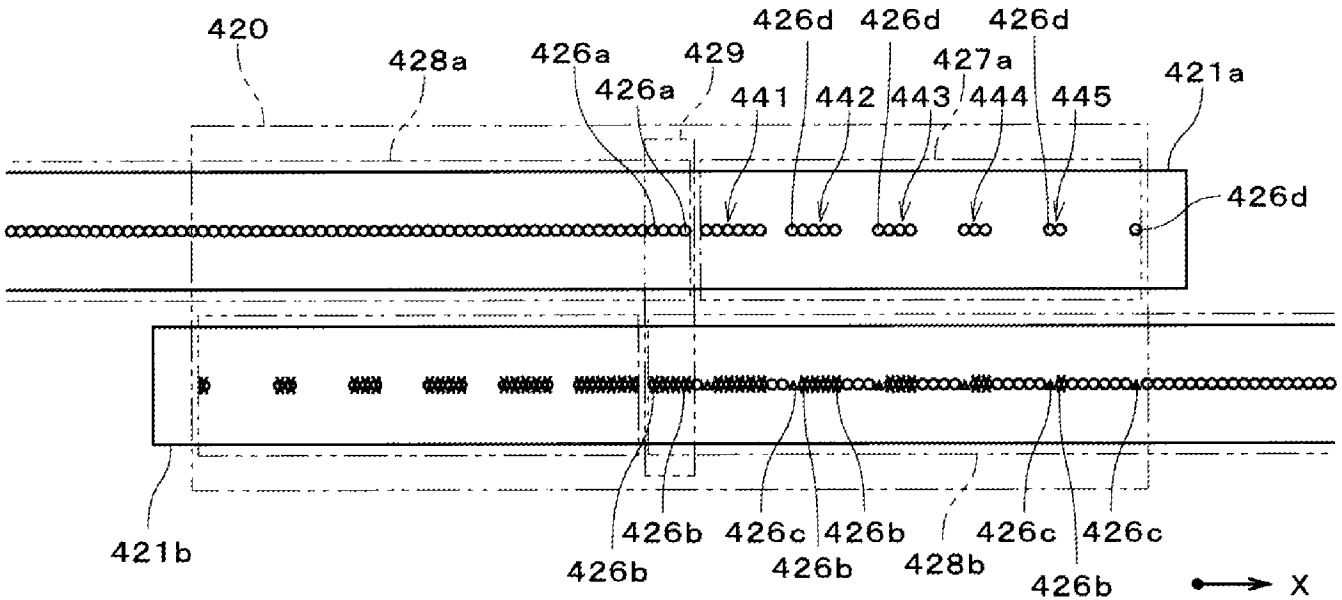
FIG. 23 illustrates the arrangement of use outlets, non-use outlets, and auxiliary outlets.

In the inkjet printer of the second embodiment, the use outlets, the non-use outlets, and the auxiliary outlets may be arranged in a different way from that shown in FIG. 21. FIG. 23 illustrates the arrangement of use outlets, non-use outlets, and auxiliary outlets of the first ejection head 421*a* and the second ejection head 421*b* in the overlapping range 420 and the vicinity thereof shown in FIG. 14. In the example shown in FIG. 23, among the outlets 426 of the second densely arranged portion 428*b* of the second ejection head 421*b* that overlap in the movement direction with the use outlet rows 441 to 445, those that overlap in the movement direction with one of the end use outlets 426*d* of each of the use outlet rows 441 to 445 are auxiliary outlets 426*c*. The outlet 426 of the second densely arranged portion 428*b* that overlaps in the movement direction with the isolated end use outlet 426*d* of the first sparsely arranged portion 427*a* is also an auxiliary outlet 426*c*. Among the outlets 426 of the second densely arranged portion 428*b* that overlap in the movement direction with the use outlet rows 441 to 445, the other outlets 426 excluding the above auxiliary outlets 426*c* are all non-use outlets 426*b* that are not used in recording an image onto the base material 9. In the dense overlapping range 429, the outlets 426 of the second densely arranged portion 428*b* that overlap in the movement direction with the use outlets 426*a* of the first densely arranged portion 428*a* are non-use outlets 426*b*.

In the example shown in FIG. 23, among the outlets 426 of the second densely arranged portion 428*b* that overlap in the movement direction with each of the use outlet rows 441 to 445, only the outlet 426 that overlaps in the movement direction with the −X-side end use outlet 426*d* is an auxiliary outlet 426*c*. Conversely, it is also possible that, among the outlets 426 of the second densely arranged portion 428*b* that overlap in the movement direction with each of the use outlet rows 441 to 445, only the outlet 426 that overlaps in the movement direction with the +X-side end use outlet 426*d* is an auxiliary outlet 426*c*. In this case, in the dense overlapping range 429, the outlet 426 of the second densely arranged portion 428*b* that overlaps in the movement direction with the use outlet 426*a* disposed furthest to the +X side of the first densely arranged portion 428*a* is an auxiliary outlet 426*c*. The other outlets 426 of the second densely arranged portion 238*b* in the dense overlapping range 429 are non-use outlets 426*b*.

In the second densely arranged portion 428*b*, whether the auxiliary outlets 426*c* are disposed at positions that overlap with the −X-side end use outlets 426*d* of the use outlet rows 441 to 445 or at positions that overlap with the +X-side end use outlets 426*d* is determined at the time of manufacture of the inkjet printer according to the second embodiment.

Specifically, first, after the assembly of the head assemblies 42, test image recording is performed on a test base material as in the first embodiment, and the use or non-use of the respective outlets 426 of the first ejection head 421*a* and the second ejection head 421*b* is determined on the basis of the displacement of the mounting position of the first ejection head 421*a* relative to the second ejection head 421*b*. This corrects the above displacement of the mounting position by an amount corresponding to an integral multiple of the arrangement pitch and reduces the influence of, for example, the occurrence of streaky unevenness caused by the above displacement of the mounting position to the same degree as in the case where the displacement of the mounting position is less than the arrangement pitch.

Subsequently, test image recording is again performed on the test base material to obtain displacement in the positions of each of the outlets 426 of the first ejection head 421*a* and each of the outlets 426 of the second ejection head 421*b* in the arrangement direction (i.e., the aforementioned post-correction positional displacement). The post-correction positional displacement is less than the arrangement pitch. Then, as shown in FIG. 23, if outlets 426 of the second densely arranged portion 428*b* that overlap in the movement direction with a region where no outlets 426 of the first sparsely arranged portion 427*a* are provided (hereinafter, referred to as a "no-outlet region") are displaced to the −X side relative to the no-outlet region, outlets 426 of the second densely arranged portion 428*b* that overlap in the movement direction with the −X-side end use outlets 426*d* of the respective use outlet rows 441 to 445 are determined as auxiliary outlets 426*c*. Conversely, if outlets 426 of the second densely arranged portion 428*b* that overlap in the movement direction with the no-outlet region of the first sparsely arranged portion 427*a* are displaced to the +X side relative to the no-outlet region, outlets 426 of the second densely arranged portion 428*b* that overlap in the movement direction with the +X-side end use outlets 426*d* of the respective use outlet rows 441 to 445 are determined as auxiliary outlets 426*c*.

In the example shown in FIG. 23, focusing on the overlapping outlet pairs that include the −X-side end use outlets 426*d* of the respective use outlet rows 441 to 445 and the auxiliary outlets 426*c* and the overlapping outlet pair that includes the isolated end use outlet 426*d* and the auxiliary outlet 426*c*, among the overlapping outlet pairs corresponding to the first sparsely arranged portion 427*a*, if the size of fine droplets of ink ejected from the end use outlets 426*d* toward dot recording positions is greater than or equal to a predetermined size, the auxiliary outlets 426*c* eject fine droplets of ink of either the small size or the medium size toward the dot recording positions, irrespective of the image data, as in the examples shown in FIGS. 15 and 21. The predetermined size is one of the large size, the medium size, and the small size as in the examples shown in FIGS. 15 and 21.

Figure 24:
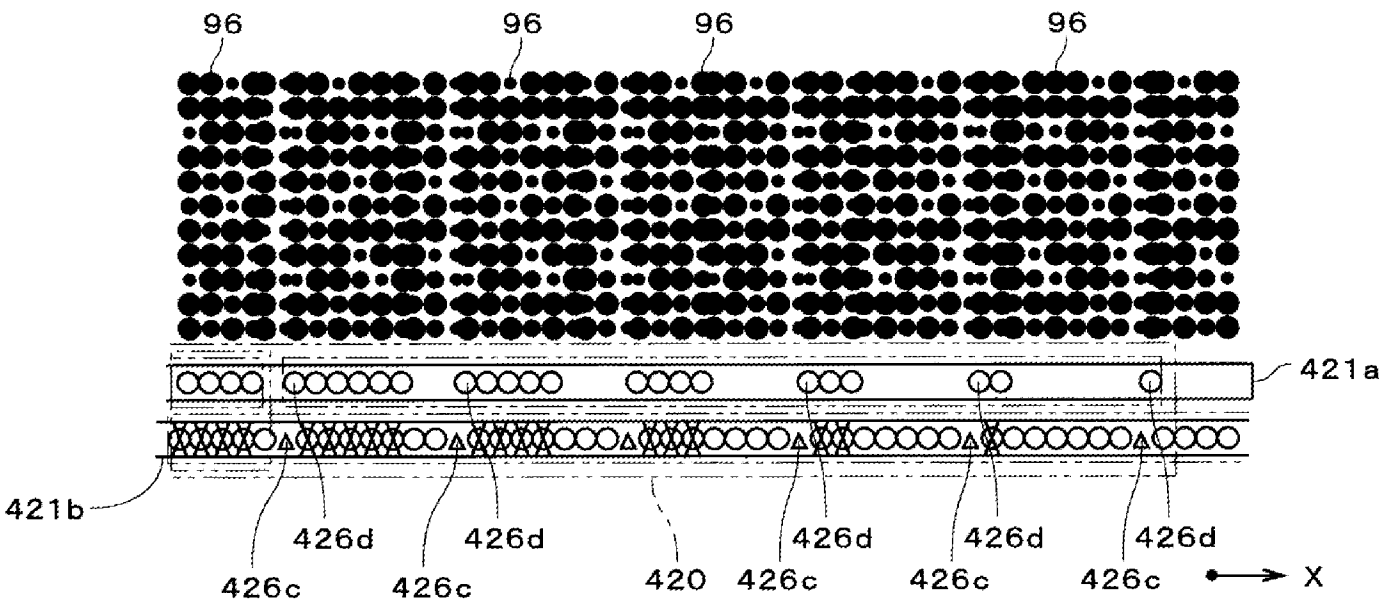
FIG. 24 illustrates dots formed on the base material.

FIG. 24 illustrates dots 96 formed on the base material 9 by some of the outlets 426 in the overlapping range 420. In the example shown in FIG. 24, the predetermined size and the size of fine droplets of ink ejected from auxiliary outlets 426*c* are both the small size as in the examples shown in FIGS. 17 and 22. In other words, if the size of fine droplets of ink ejected from end use outlets 426*d* that overlap in the movement direction with the auxiliary outlets 426*c* toward dot recording positions are one of the large size, the medium size, and the small size, the auxiliary outlets 426*c* eject fine droplets of ink of the small size toward the dot recording positions. If ink is not ejected from the end use outlets 426*d* that overlap in the movement direction with the auxiliary outlets 426*c*, the auxiliary outlets 426*c* also do not eject ink.

In the example shown in FIG. 24, even if the amount of displacement in the mounting position of the first ejection head 421*a* relative to the second ejection head 421*b* is not an integral multiple of the arrangement pitch, it is possible to suppress the occurrence of streaky unevenness such as voids to the same degree as in the examples shown in FIGS. 17 and 22. Also, the total amount of ink ejected from the auxiliary outlets 426*c* to the auxiliary ejection region of the base material 9 is smaller than in the examples shown in FIGS. 17 and 22. Accordingly, it is possible to reduce the amount of correction required in density correction performed on the outlets 426 that eject ink toward the auxiliary ejection region.

The above-described inkjet printers can be modified in various ways.

For example, the overlapping range 420 does not necessarily have to be provided with the dense overlapping range 429, and it is sufficient that the first sparsely arranged portion 427*a* entirely overlaps in the movement direction with the second densely arranged portion 428*b* and the second sparsely arranged portion 427*b* entirely overlaps in the movement direction with the first densely arranged portion 428*a*. The provision of the dense overlapping range 429 does, however, further suppress the occurrence of voids in the vicinity of the boundary between the first densely arranged portion 428*a* and the first sparsely arranged portion 427*a* as described above.

While in the embodiments described above, the ejection heads located on the upper and lower sides in FIG. 9 are respectively referred to as the "first ejection head 421*a*" and the "second ejection head 421*b*," they may be conversely referred to respectively as the "second ejection head 421*b*" and the "first ejection head 421*a*." Even in this case, a plurality of outlets of the first sparsely arranged portion 427*a* of the first ejection head 421*a* include use outlets 426*a*, and among the outlets of the second densely arranged portion 428*b* of the second ejection head 421*b*, those that overlap in the movement direction with the use outlets 426*a* of the first sparsely arranged portion 427*a* are determined as non-use outlets 426*b*. Among the outlets of the second densely arranged portion 428*b*, those that overlap in the movement direction with the non-use outlets 426*b* of the first sparsely arranged portion 427*a* and those that do not overlap in the movement direction with any of the outlets of the first sparsely arranged portion 427*a* are determined as use outlets 426*a*. Accordingly, it is possible to prevent or suppress a reduction in print quality in the overlapping range 420 of two ejection heads adjacent to each other in the arrangement direction.

In the first embodiment, both of the outlets 426 of the first sparsely arranged portion 427*a* and the outlets 426 of the second sparsely arranged portion 427*b* may be used in image recording. For example, in an overlapping range 420 shown in FIG. 25, the outlets of the first sparsely arranged portion 427*a* include both use outlets 426*a* and non-use outlets 426*b*, and the outlets of the second sparsely arranged portion 427*b* also include both use outlets 426*a* and non-use outlets 426*b*. In the dense overlapping range 429, each of the first densely arranged portion 428*a* and the second densely arranged portion 428*b* includes both use outlets 426*a* and non-use outlets 426*b*. Even in this case, it is possible, as described above, to prevent or suppress a reduction in print quality in the overlapping range 420 of two ejection heads adjacent each other in the arrangement direction.

Figure 25:
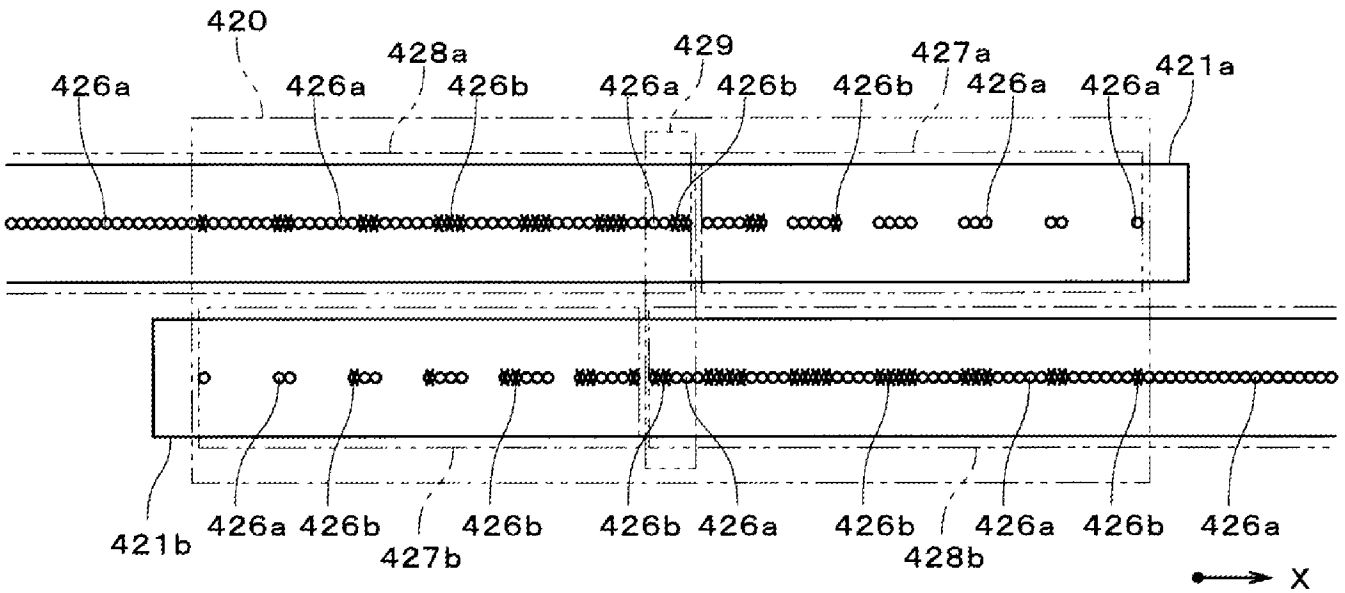
FIG. 25 is a bottom view showing the vicinity of end portions of two heads.

In the overlapping range 420 shown in FIG. 25, the number of use outlets 426*a* of the second ejection head 421*b* per unit length in the arrangement direction decreases as the distance to the +X side decreases, and the number of use outlets 426*a* of the first ejection head 421*a* per unit length in the arrangement direction increases as the distance to the +X side decreases. This consequently causes gradual changes in density in the overlapping range 420 and further reduces the possibility of such changes in density being recognized by someone viewing the image.

Each of the ejection heads 421 may be provided with only one of the head elements 425 shown in FIG. 7, or may be provided with two or more head elements 425. The arrangement of outlets 426 in each of the ejection heads 421 is not limited to that shown in FIG. 7 and may be changed in various ways. For example, in each of the ejection heads 421, a plurality of outlets 426 may be aligned in a single straight line extending in the arrangement direction such that the pitch of outlets 426 in the sparsely arranged portion 427 is greater than that in the densely arranged portion 428 so that the outlets 426 are sparsely arranged in the sparsely arranged portion 427.

The head assemblies 42 each may be provided with only two ejection heads 421. These two ejection heads 421 are disposed at different positions in the movement direction. Also, one of the ejection heads 421 is disposed at a position that is shifted from the other ejection head 421 in the movement direction.

In the inkjet printer of the second embodiment, all of a plurality of outlets of the first sparsely arranged portion 427*a* do not necessarily have to be use outlets 426*a*, and it is sufficient that the outlets of the first sparsely arranged portion 427*a* include use outlets 426*a*. In the example shown in FIG. 15, all of the outlets 426 that overlap in the movement direction with the use outlets 426*a* in the first sparsely arranged portion 427*a* do not necessarily have to be auxiliary outlets 426*c*, and it is sufficient that the outlets 426 that overlap in the movement direction with the use outlets 426*a* of the first sparsely arranged portion 427*a* include auxiliary outlets 426*c*.

In the inkjet printer of the second embodiment, it is sufficient that the size of fine droplets of ink ejected from each outlet 426 of each ejection head 421 is switchable at least between two sizes. In other words, it is sufficient that the size of fine droplets of ink is switchable at least between a first size and a second size larger than the first size. In the inkjet printer in which the size of fine droplets of ink is changeable between the above first size and the above second size, if the size of fine droplets of ink ejected from the use outlets 426*a* of the first sparsely arranged portion 427*a* is greater than or equal to a predetermined size, the auxiliary outlets 426*c* ejects fine droplets of ink of the first size. Accordingly, it is possible to suppress the occurrence of streaky unevenness such as voids even if the amount of displacement in the mounting position of the first ejection head 421*a* relative to the second ejection head 421*b* is not an integral multiple of the arrangement pitch.

Similarly, in the inkjet printer 1 of the first embodiment, the size of fine droplets of ink ejected from each outlet 426 of each ejection head 421 may be changeable among a plurality of sizes.

Depending on the design, the inkjet printer 1 may be provided with a conveying mechanism for moving the head unit 4 in the movement direction. Specifically, it is sufficient that the base material 9 and the head unit 4 are caused to move relative to each other in the movement direction. Alternatively, the base material 9 may be held on the outer circumferential surface of a substantially cylindrical drum, and a rotation mechanism for rotating this drum at a position opposing the head unit 4 may be provided as a conveying mechanism.

The inkjet printer 1 may use ink that is cured by irradiation with radiation (e.g., infrared rays or electron rays) other than UV rays. If the inkjet printer 1 uses ink that does not require irradiation with radiation, the curing part 35 may be omitted. The guideway 341 of the base material guiding part 34 does not necessarily have to be a curved surface, and it may be a flat surface. In this case, a plurality of head assemblies 42 are disposed at the same position in the Z direction.

The inkjet printer 1 may be configured to form an image on a sheet base material. For example, in an inkjet printer that holds a base material on its stage, a head unit moves relative to the stage (performs main scanning) in a scanning direction parallel to the stage while ejecting ink, then when having reached the end of the base material, moves relative to the stage (performs sub-scanning) by a predetermined distance in a movement direction that is parallel to the stage and that is perpendicular to the scanning direction, and then moves relative to the stage in a direction opposite the direction of the previous main scanning while ejecting ink. In this way, the inkjet printer described above (so-called "shuttle type printer") forms an image onto the base material by the head unit performing main scanning on the base material and intermittently performing sub-scanning in the width direction each time the main scanning has been finished.

An object on which the inkjet printer 1 forms an image may be a base material 9 other than paper. For example, the inkjet printer 1 may form an image onto a plate- or sheet-like base material 9 formed of plastic or the like.

The configurations of the embodiments and variations described above may be appropriately combined as long as there are no mutual inconsistencies.

While the invention has been shown and described in detail, the foregoing description is in all aspects illustrative and not restrictive. It is therefore to be understood that numerous modifications and variations can be devised without departing from the scope of the invention. This application claims priority benefit under 35 U.S.C. Section 119 of Japanese Patent Application No. 2013-029127 filed in the Japan Patent Office on Feb. 18, 2013 and Japanese Patent Application No. 2013-163971 filed in the Japan Patent Office on Aug. 7, 2013, the entire disclosures of which are incorporated herein by reference.

Reference Signs List

1 Inkjet printer
2 Conveying mechanism
9 Base material
42 Head assembly
81 Storage part
82 Ejection management part
83 Recording control part
421*a* First ejection head
421*b* Second ejection head
426 Outlet
426*a* Use outlet
426*b* Non-use outlet
426*c* Auxiliary outlet
426*d* End use outlet
427*a* First sparsely arranged portion
427*b* Second sparsely arranged portion
428*a* First densely arranged portion
428*b* Second densely arranged portion
429 Dense overlapping range
441 to 445 Use outlet row

The invention claimed is:

1. An inkjet printer comprising:

a head assembly for ejecting fine droplets of ink; and a conveying mechanism for causing a base material and said head assembly to move relative to each other in a predetermined movement direction, wherein said head assembly includes:

a first ejection head having outlets arranged in an arrangement direction that intersects said movement direction; and a second ejection head having outlets arranged in said arrangement direction and being disposed at a position that is different from a position of said first ejection head in said movement direction and that is shifted from said first ejection head in said arrangement direction, said first ejection head includes:

a first densely arranged portion in which outlets are arranged at a predetermined arrangement pitch in said arrangement direction; and a first sparsely arranged portion disposed adjacent to said first densely arranged portion on one side in said arrangement direction and in which outlets are more sparsely arranged in said arrangement direction than in said first densely arranged portion, said second ejection head includes:

a second densely arranged portion in which outlets are arranged at said arrangement pitch in said arrangement direction; and a second sparsely arranged portion disposed adjacent to said second densely arranged portion on the other side in said arrangement direction and in which outlets are more sparsely arranged in said arrangement direction than in said second densely arranged portion, said first sparsely arranged portion entirely overlaps in said movement direction with said second densely arranged portion, said second sparsely arranged portion entirely overlaps in said movement direction with said first densely arranged portion, said outlets of said first sparsely arranged portion include a use outlet that is used in recording an image onto said base material, and among said outlets of said second densely arranged portion, an outlet that overlaps in said movement direction with said use outlet of said first sparsely arranged portion is a non-use outlet that is not used in recording an image onto said base material.

2. The inkjet printer according to claim 1, wherein said outlets of said first sparsely arranged portion are all use outlets, and said outlets of said second sparsely arranged portion are all non-use outlets.

3. The inkjet printer according to claim 2, wherein in a dense overlapping range in said arrangement direction, part of said first densely arranged portion and part of said second densely arranged portion overlap with each other in said movement direction, and out of each two outlets that overlap with each other in said movement direction in said dense overlapping range, one outlet is a use outlet and the other outlet is a non-use outlet.

4. The inkjet printer according to claim 3, further comprising:

a storage part for storing relationship information indicating a relationship between a plurality of overlapping states of said outlets of said first ejection head and said outlets of said second ejection head in said movement direction and use states of said outlets of said first sparsely arranged portion, said use states respectively corresponding to said plurality of overlapping states; and an ejection management part for, on the basis of said relationship information and an overlapping state between said outlets of said first ejection head and said outlets of said second ejection head, determining use or non-use of each outlet of said first sparsely arranged portion and determining, among said outlets of said second densely arranged portion, use or non-use of each outlet that overlaps in said movement direction with said first sparsely arranged portion.

5. The inkjet printer according to claim 4, wherein in said first sparsely arranged portion, the number of outlets per unit length in said arrangement direction decreases as a distance in said arrangement direction from said first densely arranged portion increases.

6. The inkjet printer according to claim 1, wherein in a dense overlapping range in said arrangement direction, part of said first densely arranged portion and part of said second densely arranged portion overlap with each other in said movement direction, and out of each two outlets that overlap with each other in said movement direction in said dense overlapping range, one outlet is a use outlet and the other outlet is a non-use outlet.

7. The inkjet printer according to claim 6, further comprising:

a storage part for storing relationship information indicating a relationship between a plurality of overlapping states of said outlets of said first ejection head and said outlets of said second ejection head in said movement direction and use states of said outlets of said first sparsely arranged portion, said use states respectively corresponding to said plurality of overlapping states; and an ejection management part for, on the basis of said relationship information and an overlapping state between said outlets of said first ejection head and said outlets of said second ejection head, determining use or non-use of each outlet of said first sparsely arranged portion and determining, among said outlets of said second densely arranged portion, use or non-use of each outlet that overlaps in said movement direction with said first sparsely arranged portion.

8. The inkjet printer according to claim 7, wherein in said first sparsely arranged portion, the number of outlets per unit length in said arrangement direction decreases as a distance in said arrangement direction from said first densely arranged portion increases.

9. The inkjet printer according to claim 1, further comprising:

a storage part for storing relationship information indicating a relationship between a plurality of overlapping states of said outlets of said first ejection head and said outlets of said second ejection head in said movement direction and use states of said outlets of said first sparsely arranged portion, said use states respectively corresponding to said plurality of overlapping states; and an ejection management part for, on the basis of said relationship information and an overlapping state between said outlets of said first ejection head and said outlets of said second ejection head, determining use or non-use of each outlet of said first sparsely arranged portion and determining, among said outlets of said second densely arranged portion, use or non-use of each outlet that overlaps in said movement direction with said first sparsely arranged portion.

10. The inkjet printer according to claim 9, wherein in said first sparsely arranged portion, the number of outlets per unit length in said arrangement direction decreases as a distance in said arrangement direction from said first densely arranged portion increases.

11. The inkjet printer according to claim 1, wherein in said first sparsely arranged portion, the number of outlets per unit length in said arrangement direction decreases as a distance in said arrangement direction from said first densely arranged portion increases.

12. The inkjet printer according to claim 1, further comprising:

a recording control part for controlling said head assembly and said conveying mechanism to cause said base material and said head assembly to move relative to each other once in said movement direction and to record an image onto said base material.

13. An inkjet printer comprising:

a head assembly for ejecting fine droplets of ink; and a conveying mechanism for causing a base material and said head assembly to move relative to each other in a predetermined movement direction, wherein said head assembly includes:

a first ejection head having outlets arranged in an arrangement direction that intersects said movement direction; and a second ejection head having outlets arranged in said arrangement direction and being disposed at a position that is different from a position of said first ejection head in said movement direction and that is shifted from said first ejection head in said arrangement direction, a size of the fine droplets of ink ejected from said outlets of said first ejection head and said second ejection head is switchable between a first size and a second size larger than said first size, said first ejection head includes:

a first densely arranged portion in which outlets are arranged at a predetermined arrangement pitch in said arrangement direction; and a first sparsely arranged portion disposed adjacent to said first densely arranged portion on one side in said arrangement direction and in which outlets are more sparsely arranged in said arrangement direction than in said first densely arranged portion, said second ejection head includes:

a second densely arranged portion in which outlets are arranged at said arrangement pitch in said arrangement direction; and a second sparsely arranged portion disposed adjacent to said second densely arranged portion on the other side in said arrangement direction and in which outlets are more sparsely arranged in said arrangement direction than in said second densely arranged portion, said first sparsely arranged portion entirely overlaps in said movement direction said second densely arranged portion, said second sparsely arranged portion entirely overlaps in said movement direction with said first densely arranged portion, said outlets of said first sparsely arranged portion include a use outlet that is used in recording an image onto said base material, among said outlets of said second densely arranged portion, an outlet that overlaps in said movement direction with said use outlet of said first sparsely arranged portion includes an auxiliary outlet that is used in an auxiliary manner in recording an image onto said base material, and if a size of the fine droplets of ink ejected from said use outlet of said first sparsely arranged portion is greater than or equal to a predetermined size, said auxiliary outlet ejects fine droplets of ink of said first size.

14. The inkjet printer according to claim 13, wherein said outlets of said first sparsely arranged portion include a use outlet row that is a set of use outlets arranged at said arrangement pitch in said arrangement direction, and where two use outlets located at opposite ends in said arrangement direction of said use outlet row are end use outlets, among outlets of said second densely arranged portion that overlap in said movement direction with said use outlet row, an outlet that overlaps in said movement direction with one of said end use outlets in said use outlet row is an auxiliary outlet, and the other outlets are all non-use outlets that are not used in recording an image onto said base material.

15. The inkjet printer according to claim 14, wherein in said first sparsely arranged portion, the number of outlets per unit length in said arrangement direction decreases as a distance in said arrangement direction from said first densely arranged portion increases.

16. The inkjet printer according to claim 13, wherein said outlets of said first sparsely arranged portion include a use outlet row that is a set of at least three use outlets arranged at said arrangement pitch in said arrangement direction, and where two use outlets located at opposite ends in said arrangement direction of said use outlet row are end use outlets, among outlets of said second densely arranged portion that overlap in said movement direction with said use outlet row, outlets that overlap in said movement direction with said two end use outlets in said use outlet row are auxiliary outlets, and the other outlets are all non-use outlets that are not used in recording an image onto said base material.

17. The inkjet printer according to claim 16, wherein in said first sparsely arranged portion, the number of outlets per unit length in said arrangement direction decreases as a distance in said arrangement direction from said first densely arranged portion increases.

18. The inkjet printer according to claim 13, wherein in said first sparsely arranged portion, the number of outlets per unit length in said arrangement direction decreases as a distance in said arrangement direction from said first densely arranged portion increases.

19. The inkjet printer according to claim 13, further comprising:

a recording control part for controlling said head assembly and said conveying mechanism to cause said base material and said head assembly to move relative to each other once in said movement direction and to record an image onto said base material.

* * * * *